US010268157B2

(12) United States Patent
Ozawa

(10) Patent No.: US 10,268,157 B2
(45) Date of Patent: Apr. 23, 2019

(54) IMAGE FORMING APPARATUS INCLUDING CARTRIDGE SUPPORT MEMBER AND CARTRIDGE INCLUDING MOVABLE DETECTION MEMBER

(71) Applicant: Brother Kogyo Kabushiki Kaisha, Nagoya-shi, Aichi-ken (JP)

(72) Inventor: Atsushi Ozawa, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/701,539

(22) Filed: Sep. 12, 2017

(65) Prior Publication Data

US 2018/0088524 A1 Mar. 29, 2018

(30) Foreign Application Priority Data

Sep. 23, 2016 (JP) ..... 2016-185336

(51) Int. Cl.
*G03G 21/18* (2006.01)
*G03G 21/16* (2006.01)

(52) U.S. Cl.
CPC ..... *G03G 21/1842* (2013.01); *G03G 21/1652* (2013.01); *G03G 21/1821* (2013.01); *G03G 21/1853* (2013.01); *G03G 21/1867* (2013.01); *G03G 21/1676* (2013.01); *G03G 21/186* (2013.01); *G03G 21/1885* (2013.01); *G03G 21/1892* (2013.01)

(58) Field of Classification Search
CPC ..... G03G 21/1652; G03G 21/1676; G03G 21/1842; G03G 21/1857; G03G 21/1864; G03G 21/1867; G03G 21/1871; G03G 21/1885; G03G 21/1892; G03G 21/1896; G03G 2221/166; G03G 2221/1684; G03G 2221/1869
See application file for complete search history.

(56) References Cited

U.S. PATENT DOCUMENTS 7,756,426 B2 7/2010 Kamimura
8,417,130 B2 4/2013 Hashimoto
(Continued)

FOREIGN PATENT DOCUMENTS

JP 2007-047314 A 2/2007
JP 2011-180268 A 9/2011
JP 2013-054053 A 3/2013

*Primary Examiner* — Thomas S Giampaolo, II
(74) *Attorney, Agent, or Firm* — Banner & Witcoff, Ltd.

(57) ABSTRACT

A main-body-side electrical contact is provided at a housing of an image forming apparatus. A cartridge including a detection member is detachably attachable to a cartridge support member. A lever provided at the cartridge support member includes a support-member-side electrical contact. The lever is movable between a first position, at which the main-body-side electrical contact is out of electrical contact with the support-member-side electrical contact, and a second position, at which the main-body-side electrical contact is in electrical contact with the support-member-side electrical contact, by a driving force transmitted from the detection member in a state where the cartridge is attached to the cartridge support member and the cartridge support member is positioned at an inside position. A detector detects electrical connection between the main-body-side electrical contact and the support-member-side electrical contact when the lever is in the second position.

29 Claims, 14 Drawing Sheets

(56) References Cited

U.S. PATENT DOCUMENTS

| | | | |
|---|---|---|---|
| 8,861,986 | B2 | 10/2014 | Hashimoto |
| 2007/0031158 | A1 | 2/2007 | Kamimura |
| 2011/0211866 | A1 | 9/2011 | Hashimoto |
| 2013/0051816 | A1 | 2/2013 | Itabashi |
| 2013/0202317 | A1 | 8/2013 | Hashimoto |

IMAGE FORMING APPARATUS INCLUDING CARTRIDGE SUPPORT MEMBER AND CARTRIDGE INCLUDING MOVABLE DETECTION MEMBER

CROSS REFERENCE TO RELATED APPLICATION

This application claims priority from Japanese Patent Application No. 2016-185336 filed Sep. 23, 2016. The entire content of the priority application is incorporated herein by reference.

TECHNICAL FIELD

The present disclosure relates to an image forming apparatus and a drum unit.

BACKGROUND

There has been known an image forming apparatuses of a type that is provided with a plurality of cartridges accommodating toner therein. The cartridges can be attached to, and detached from, the image forming apparatus.

Prior art discloses an image forming apparatus that includes a drum unit and a plurality of developer cartridges. The drum unit can hold a plurality of developer cartridges. The drum unit is movable between an inside position, at which the drum unit is disposed inside of the casing of the image forming apparatus, and an outside position, at which the drum unit is disposed outside of the casing of the image forming apparatus.

Each developer cartridge includes a detecting gear. The detecting gear includes a protrusion. The drum unit includes a lever. The main body casing includes a photo-sensor. After the developer cartridge is attached to the drum unit, when the detection gear rotates, the protrusion abuts on the lever, whereupon the lever pivotally moves. The photo-sensor detects the pivotal movement of the lever, and generates a signal. Based on the signal outputted from the photo-sensor, the image forming apparatus acquires the information on the developer cartridge.

SUMMARY

There is a demand for downsizing the above-described conventional image forming apparatus.

An object of the disclosure is therefore to provide an image forming apparatus and a drum unit which can be made smaller in size.

According to one aspect, an image forming apparatus is provided. The image forming apparatus includes: a housing; a drive source; a cartridge; a main-body-side electrical contact; a cartridge support member; a lever; and a detector. The cartridge is configured to accommodate toner therein. The cartridge includes a detection member movable upon receipt of driving force from the drive source. The main-body-side electrical contact is provided at the housing. The cartridge is detachably attachable to the cartridge support member. The cartridge support member is movable between an inside position at which the cartridge support member is positioned inside the housing, and an outside position at which the cartridge support member is positioned outside of the housing. The lever is provided at the cartridge support member. The lever includes a support-member-side electrical contact. The lever is movable between a first position and a second position by driving force transmitted from the detection member in a state where the cartridge is attached to the cartridge support member and the cartridge support member is positioned at the inside position. In the first position, the main-body-side electrical contact is out of electrical contact with the support-member-side electrical contact. In the second position, the main-body-side electrical contact is in electrical contact with the support-member-side electrical contact. The detector is configured to detect electrical connection between the main-body-side electrical contact and the support-member-side electrical contact when the lever is in the second position.

According to another aspect, a drum unit, to which a cartridge is detachably attachable, is provided. The cartridge is configured to accommodate toner therein and includes a detection member movable upon receipt of driving force. The drum unit includes: a photosensitive drum; and a lever including an electrical contact. The lever is movable upon receipt of driving force from the detection member in a state where the cartridge is attached to the drum unit.

BRIEF DESCRIPTION OF THE DRAWINGS

The particular features and advantages of the disclosure will become apparent from the following description taken in connection with the accompanying drawings, in which:

FIGS. 9-14 illustrate how various components provided to the magenta-toner cartridge and various components provided to the cartridge support member for the magenta-toner cartridge are moved, wherein:

FIG. 9 illustrates how a shaft and a detecting protrusion of the magenta-toner cartridge and the lever of the cartridge support member for the magenta-toner cartridge are located in a state where the magenta-toner cartridge is at an unlocked position and the lever is at a fourth position;

FIG. 10 illustrates how the support-member-side developing-bias electrode, tension spring, lever, and connecting member of the cartridge support member for the magenta-toner cartridge are located in the state shown in FIG. 9;

FIG. 11 illustrates how the shaft and the detecting protrusion of the magenta-toner cartridge and the lever of the cartridge support member for the magenta-toner cartridge are located in a state where the magenta-toner cartridge is at a locked position and the lever is at a first position;

FIG. 12 illustrates how the support-member-side developing-bias electrode, tension spring, lever, and connecting member of the cartridge support member for the magenta-toner cartridge are located in the state shown in FIG. 11;

FIG. 13 illustrates how the shaft and the detecting protrusion of the magenta-toner cartridge and the lever of the cartridge support member for the magenta-toner cartridge are located in a state where the magenta-toner cartridge is at the locked position and the lever is at a second position; and FIG. 14 illustrates how the support-member-side developing-bias electrode, tension spring, lever, and connecting member of the cartridge support member for the magenta-toner cartridge are located in the state shown in FIG. 13.

DETAILED DESCRIPTION

Figure 1:
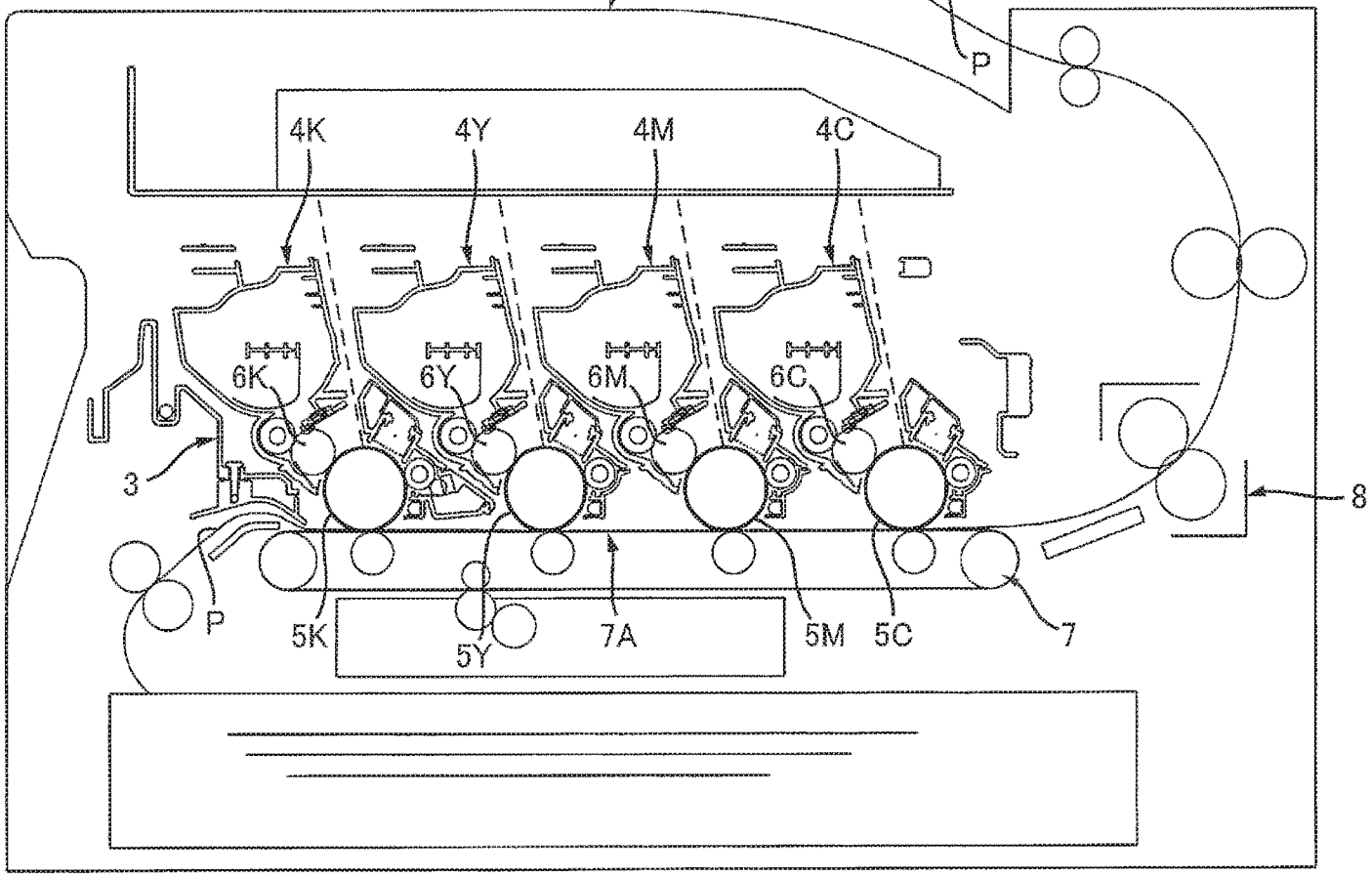
FIG. 1 schematically illustrates a structure of an image forming apparatus according to an embodiment.

An image forming apparatus according to an embodiment will be described while referring to the accompanying drawings wherein like parts and components are designated by the same reference numerals to avoid duplicating description.

1. Outline of the Image Forming Apparatus

An image forming apparatus 1 will be schematically described with reference to FIGS. 1, 2, 7, and 8.

Figure 2:
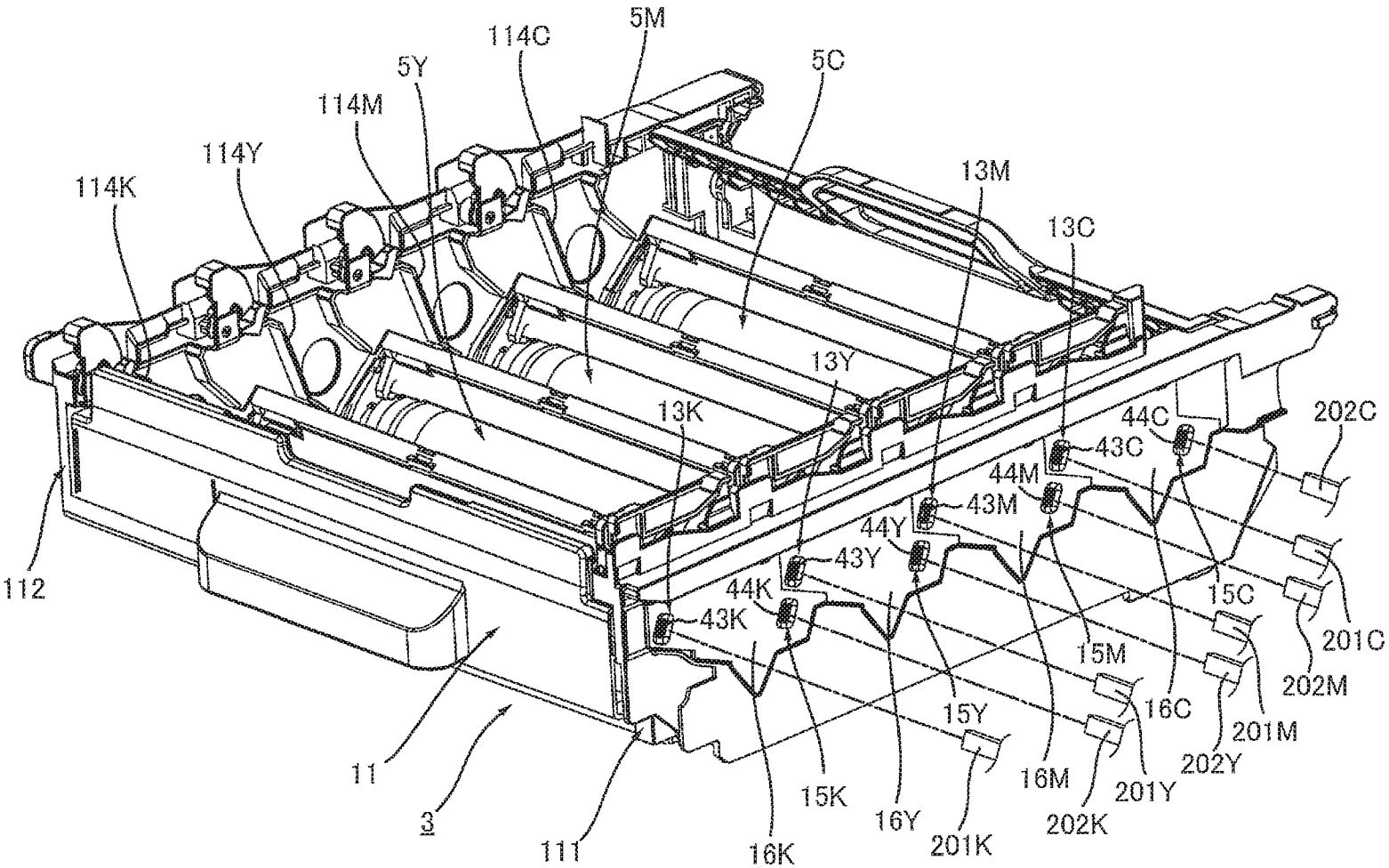
FIG. 2 is a perspective view showing an entire part of a cartridge support member in a state where the cartridge support member is removed from a housing of the image forming apparatus and is disposed outside the housing.
Figure 7:
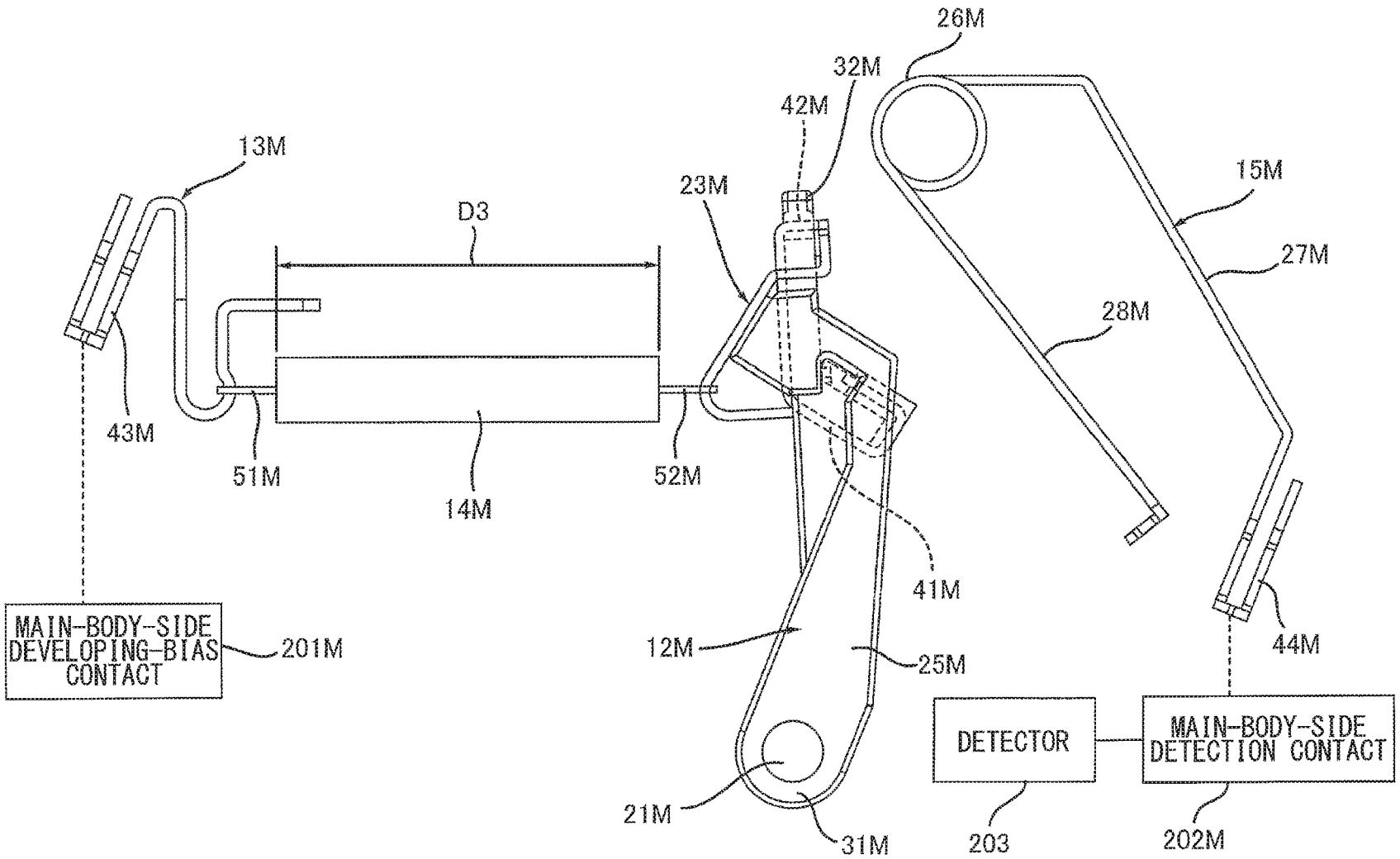
FIG. 7 illustrates how the support-member-side developing-bias electrode, the tension spring, the lever, and the connecting member for the magenta-toner cartridge are located in a state where the magenta-toner cartridge is not supported in the cartridge support member.
Figure 8:
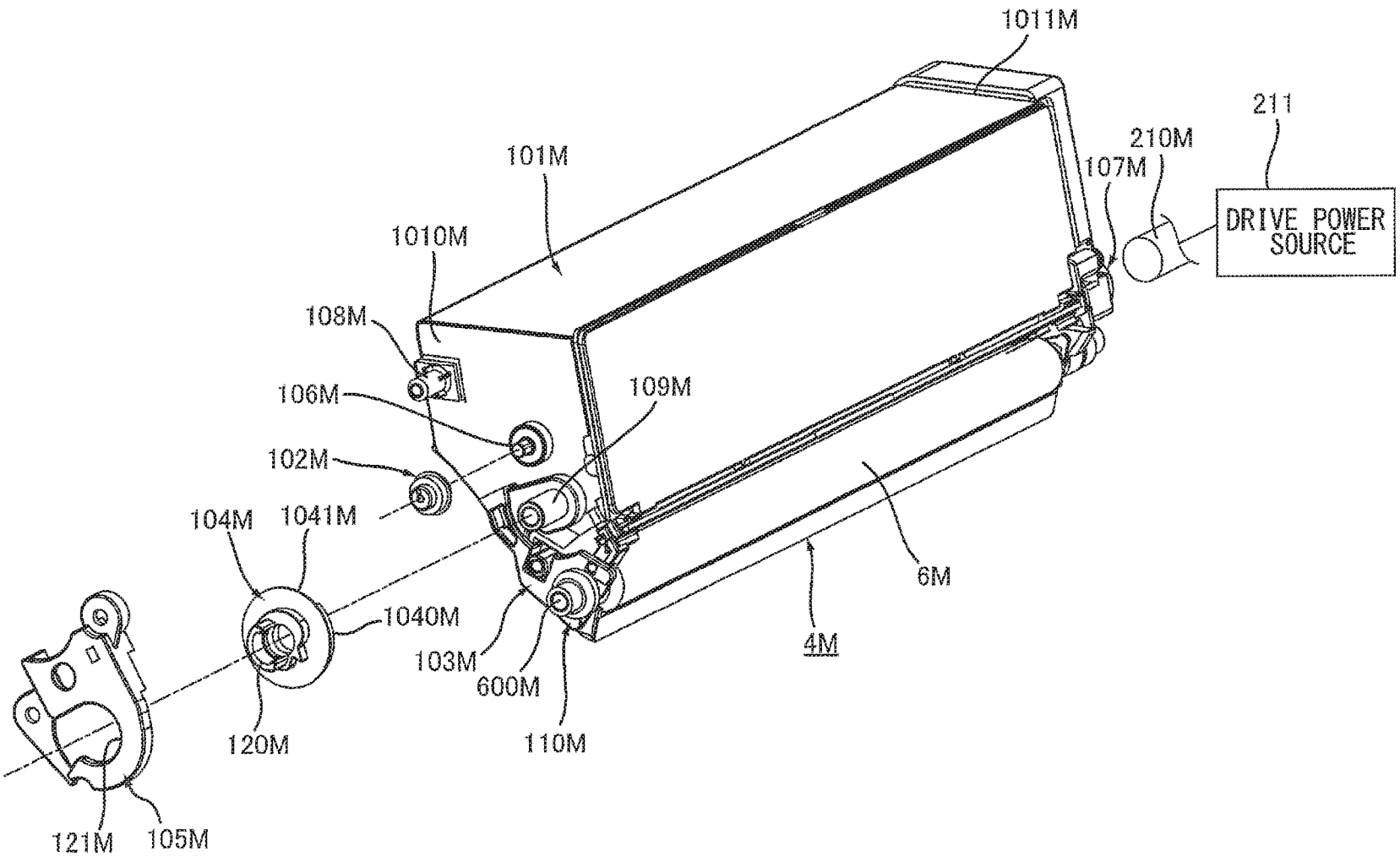
FIG. 8 is a partially exploded perspective view of the magenta-toner cartridge.

As shown in FIG. 1, the image forming apparatus 1 includes: a housing 2; a cartridge support member 3; and a plurality of cartridges 4K, 4Y, 4M and 4C. The cartridge 4K stores black toner. The cartridge 4Y stores yellow toner. The cartridge 4M stores magenta toner. The cartridge 4M will be referred to also as "magenta-toner cartridge 4M" hereinafter. The cartridge 4C stores cyan toner. As shown in FIGS. 2 and 7, the image forming apparatus 1 includes: main-body-side developing-bias contacts 201K, 201Y, 201M and 201C (FIG. 2); main-body-side detection contacts 202K, 202Y, 202M and 202C (FIG. 2); and a detector 203 (FIG. 7). The image forming apparatus 1 further includes: a drive power source 211 (e.g., motor) and main-body-side couplings 210K, 210Y, 210M and 210C, among which only the drive power source 211 and the main-body-side coupling 210M are shown in FIG. 8.

1.1 Housing

As shown in FIG. 1, the housing 2 constitutes an outer shell of the image forming apparatus 1. The housing 2 accommodates therein the cartridge support member 3 and the cartridges 4K, 4Y, 4M and 4C.

1.2 Main-Body-Side Developing-Bias Contacts and Main-Body-Side Detection Contacts As shown in FIG. 2, the main-body-side developing-bias contacts 201K, 201Y, 201M and 201C are provided in the housing 2. The main-body-side developing-bias contacts 201K, 201Y, 201M and 201C are configured to apply developing biases to support-member-side developing-bias electrodes 13K, 13Y, 13M and 13C (described later), respectively. That is, the main-body-side developing-bias contacts 201K, 201Y, 201M and 201C are configured so as to be electrically connected to the support-member-side developing-bias electrodes 13K, 13Y, 13M and 13C, respectively.

The main-body-side detection contacts 202K, 202Y, 202M and 202C are provided in the housing 2. All of the main-body-side detection contacts 202K, 202Y, 202M and 202C are in electrical connection with the single detector 203 (see FIG. 7).

1.3 Detector

As shown in FIG. 7, the detector 203 is provided in the housing 2. The detector 203 is an electrical circuit configured to detect: whether the main-body-side detection contact 202K is brought into electrical connection with a support-member-side detection contact 42K constituting a lever 12K (described later); whether the main-body-side detection contact 202Y is brought into electrical connection with a support-member-side detection contact 42Y constituting a lever 12Y (to be described later); whether the main-body-side detection contact 202M is brought into electrical connection with a support-member-side detection contact 42M constituting a lever 12M (described later); and whether the main-body-side detection contact 202C is brought into electrical connection with a support-member-side detection contact 42C constituting a lever 12C (described later).

1.4 Drive Mechanism

As shown in FIG. 8, the main-body-side couplings 210K, 210Y, 210M and 210C are provided in the housing 2. The main-body-side coupling 210K is configured so as to be connected to a coupling 107K provided to the cartridge 4K. The main-body-side coupling 210Y is configured so as to be connected to a coupling 107Y provided to the cartridge 4Y. The main-body-side coupling 210M is configured so as to be connected to a coupling 107M provided to the cartridge 4M. The main-body-side coupling 210C is configured so as to be connected to a coupling 107C provided to the cartridge 4C.

The drive power source 211 is provided in the housing 2. The drive power source 211 is configured to supply drive force to the main-body-side couplings 210K, 210Y, 210M and 210C.

1.5 Cartridge Support Member

As shown in FIG. 1, the cartridge support member 3 is configured to support the cartridges 4K, 4Y, 4M and 4C. The cartridges 4K, 4Y, 4M and 4C can be attached to and detached from the cartridge support member 3. The cartridge support member 3 is movable between an inside position, at which the cartridge support member 3 is disposed inside the housing 2, and an outside position, at which the cartridge support member 3 is disposed outside the housing 2. The cartridge support member 3 can be inserted into and removed from the housing 2. Instead, the cartridge support member 3 may not be removed from the housing 2. In the present example, the cartridge support member 3 is a drum unit including a plurality of photosensitive drums 5K, 5Y, 5M and 5C.

In the cartridge support member 3, the photosensitive drums 5K, 5Y, 5M and 5C are arranged in a prescribed direction with intervals therebetween. The direction in which the photosensitive drums 5K, 5Y, 5M and 5C are arranged will be referred to as an "arrangement direction" hereinafter. The cartridge support member 3 is movable in the arrangement direction between the inside position and the outside position. Each of the photosensitive drums 5K, 5Y, 5M and 5C extends along its axis that extends in an axial direction, and is rotatable around the axis. The axial direction of each of the photosensitive drums 5K, 5Y, 5M and 5C will be referred to also as "a drum-axial direction" hereinafter. The drum-axial direction intersects with the arrangement direction. Preferably, the drum-axial direction is perpendicular to the arrangement direction. Electrostatic latent images are formed on the surfaces of the photosensitive drums 5K, 5Y, 5M and 5C, respectively.

1.6 Cartridges

The cartridges 4K, 4Y, 4M and 4C can be attached to, and detached from, the cartridge support member 3. When the cartridges 4K, 4Y, 4M and 4C are attached to the cartridge support member 3, the cartridges 4K, 4Y, 4M and 4C are arranged in the arrangement direction with the intervals therebetween. The cartridge 4K is configured to supply toner to the photosensitive drum 5K, thereby developing an electrostatic latent image formed on the surface of the photosensitive drum 5K. The cartridge 4Y is configured to supply toner to the photosensitive drum 5Y, thereby developing an electrostatic latent image formed on the surface of the photosensitive drum 5Y. The cartridge 4M is configured to supply toner to the photosensitive drum 5M, thereby developing an electrostatic latent image formed on the surface of the photosensitive drum 5M. The cartridge 4C is configured to supply toner to the photosensitive drum 5C, thereby developing an electrostatic latent image formed on the surface of the photosensitive drum 5C.

As shown in FIG. 1, the cartridge 4K is a developer cartridge including a developing roller 6K. The developing roller 6K of the cartridge 4K contacts the photosensitive drum 5K when the cartridge 4K is attached in the cartridge support member 3. The cartridge 4Y is a developer cartridge including a developing roller 6Y. The developing roller 6Y of the cartridge 4Y contacts the photosensitive drum 5Y when the cartridge 4Y is attached in the cartridge support member 3. The cartridge 4M is a developer cartridge including a developing roller 6M. The developing roller 6M of the cartridge 4M contacts the photosensitive drum 5M when the cartridge 4M is attached in the cartridge support member 3. The cartridge 4C is a developer cartridge including a developing roller 6C. The developing roller 6C of the cartridge 4C contacts the photosensitive drum 5C when the cartridge 4C is in the cartridge support member 3.

1.7 Belt Unit and Fixing Device

The image forming apparatus 1 further includes a belt unit 7 and a fixing device 8. The belt unit 7 is configured to transfer toner images from the surfaces of the photosensitive drums 5K, 5Y, 5M and 5C onto a sheet P. The belt unit 7 includes a conveying belt 7A. The conveying belt 7A is configured to convey the sheet P in the arrangement direction. The sheet P contacts the respective ones of the photosensitive drums 5K, 5Y, 5M, and 5C, while being conveyed by the conveying belt 7A. Toner images formed on the surfaces of the photosensitive drums 5K, 5Y, 5M and 5C are transferred from the photosensitive drums 5K, 5Y, 5M and 5C onto the sheet P. The fixing device 8 is configured to apply heat and pressure to the sheet P, onto which the toner images have been transferred, thereby fixing the toner images on the sheet P.

2. Structure of the Cartridges

The cartridges 4K, 4Y, 4M and 4C have the same structure with one another. Hence, the cartridge 4M will be described below with reference to FIG. 8 as a representative example of the cartridges 4K, 4Y, 4M and 4C.

The cartridge 4M includes: a cartridge housing 101M; a developing electrode 103M; a detection member 104M; and a cover 105M.

2.1 Cartridge Housing

The cartridge housing 101M extends in an axial direction of the developing roller 6M. The axial direction of the developing roller 6M will be referred to also as a "developing-roller axial direction" hereinafter. The cartridge housing 101M has one end wall 1010M and another end wall 1011M spaced apart from each other in the developing-roller axial direction. The cartridge housing 101M is configured to accommodate toner therein.

A boss 108M is provided on an outer surface of the end wall 1010M. The boss 108M protrudes from the outer surface of the end wall 1010M. The boss 108M has a cylindrical shape extending in the developing-roller axial direction.

The coupling 107M is provided on the other end wall 1011M of the cartridge housing 101M. The coupling 107M is coupled to the main-body-side coupling 210M while the cartridge support member 3, supporting the cartridge 4M, stays at the inside position. When the coupling 107M is coupled to the main-body-side coupling 210M, the coupling 107M becomes capable of rotating together with the main-body-side coupling 210M. That is, the coupling 107M becomes capable of receiving a drive force from the drive power source 211 via the main-body-side coupling 210M.

An agitator is provided inside the cartridge housing 101M. The agitator includes an agitator shaft 106M extending in the developing-roller axial direction. The drive force that the coupling 107M received is transmitted from the coupling 107M to the agitator shaft 106M via a gear mechanism (not shown) provided on the outer surface of the other end wall 1011M. The agitator is rotatable together with the agitator shaft 106M around an axis of the agitator shaft 106M. The agitator is configured to agitate toner in the cartridge housing 101M and supply the toner to the developing roller 6M. One end of the agitator shaft 106M penetrates the end wall 1010M of the cartridge housing 101M and protrude outside of the cartridge housing 101M. An agitator gear 102M is attached to the one end of the agitator shaft 106M that is disposed at the outward side of the end wall 1010M in the developing-roller axial direction. The agitator gear 102M is rotatable together with the agitator shaft 106M.

2.2 Developing Electrode

The developing electrode 103M is fixedly secured to the outer surface of the end wall 1010M. The developing electrode 103M includes: a bearing 110M; and a shaft 109M extending from the bearing 110M outwardly in the developing-roller axial direction. In other words, the cartridge 4M includes the shaft 109M. The developing electrode 103M is formed of electrically conductive material such as electrically conductive resin.

Figure 12:
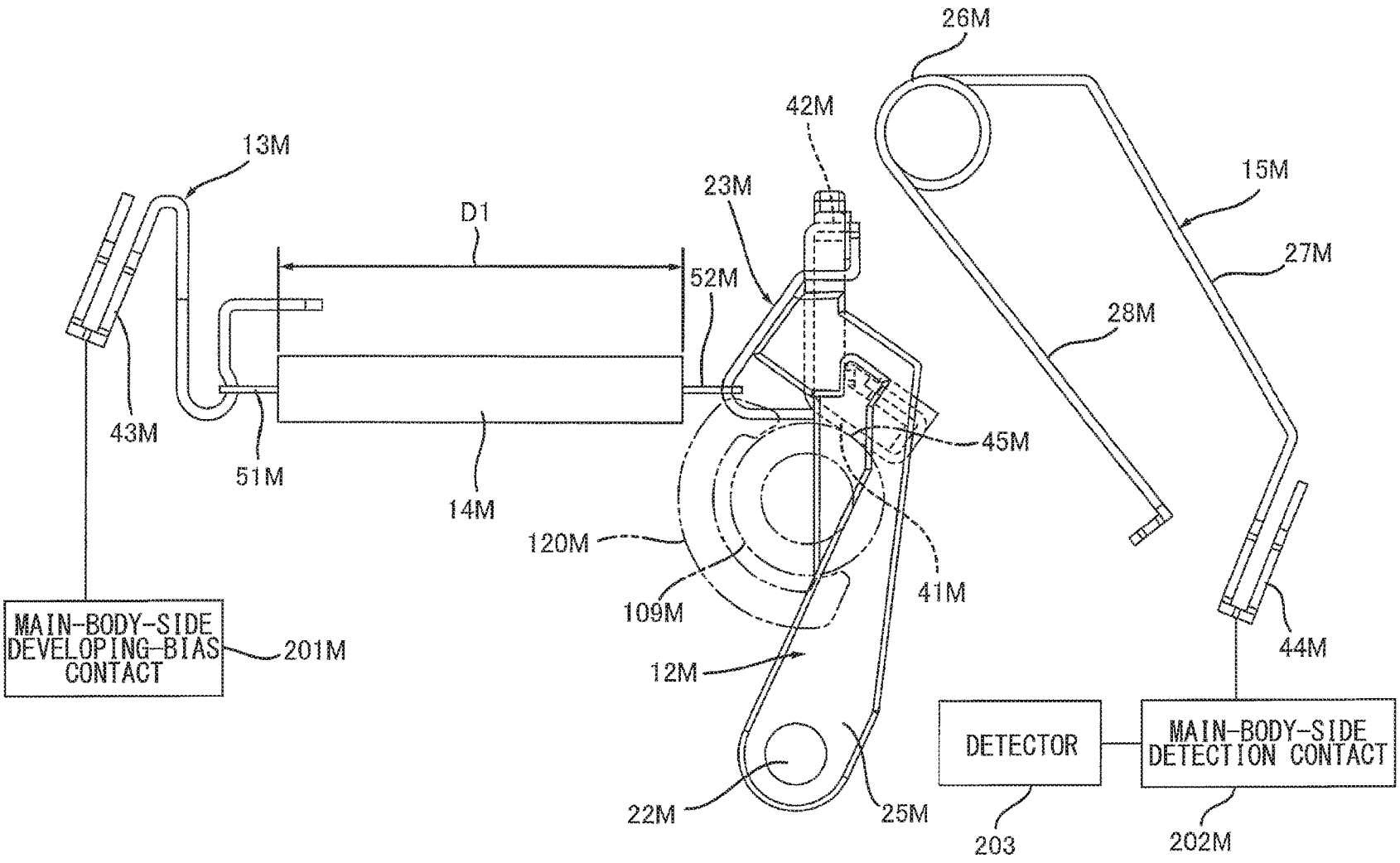

The shaft 109M has a cylindrical shape extending in the developing-roller axial direction. As will be described later, the shaft 109M includes a cartridge-side developing-bias contact 45M on its circumferential surface (FIG. 12). It can also be said that the cartridge 4M has the cartridge-side developing-bias contact 45M.

The bearing 110M is a component for supporting the developing roller 6M. That is, a developing roller shaft 600M of the developing roller 6M is inserted through the bearing 110M. The developing roller shaft 600M is made of metal. Because the bearing 110M is in contact with the developing roller shaft 600M, the developing electrode 103M is electrically connected to the developing roller 6M. With this configuration, the cartridge-side developing-bias contact 45M of the shaft 109M is electrically connected to the developing roller 6M.

2.3 Detection Member

The detection member 104M is mounted to the shaft 109M so as to be rotatable around the shaft 109M. The detection member 104M includes gear teeth provided in a portion of the circumference of the detection member 104M in a rotational direction thereof. More specifically, the detection member 104M is a tooth-missing gear including a teeth portion 1040M and a tooth-missing portion 1041M. The teeth portion 1040M includes gear teeth arranged in the rotational direction of the detection member 104M. The tooth-missing portion 1041M includes no gear teeth, and extends in the rotational direction of the detection member 104M. The detection member 104M receives drive force from the drive power source 211 to rotate, only while the teeth portion 1040M is in meshingly engagement with the agitator gear 102M.

The detection member 104M includes a detecting protrusion 120M which protrudes from the detection member 104M in the developing-roller axial direction. The detecting protrusion 120M extends also in the rotational direction of the detection member 104M such that the detecting protrusion 120M covers a portion of the circumferential surface of the shaft 109M in the rotating direction of the detection member 104M. The detecting protrusion 120M is rotatable together with the detection member 104M.

2.4 Cover

The cover 105M is fixedly secured to the outer surface of the end wall 1010M of the cartridge housing 101M. The cover 105M is for covering a portion of the detection member 104M. More specifically, the cover 105M has an opening 121M, in which the detecting protrusion 120M is inserted.

3. Detailed Description of the Cartridge Support Member

The cartridge support member 3 will now be described in detail with reference to FIGS. 2 to 7.

Figure 3:
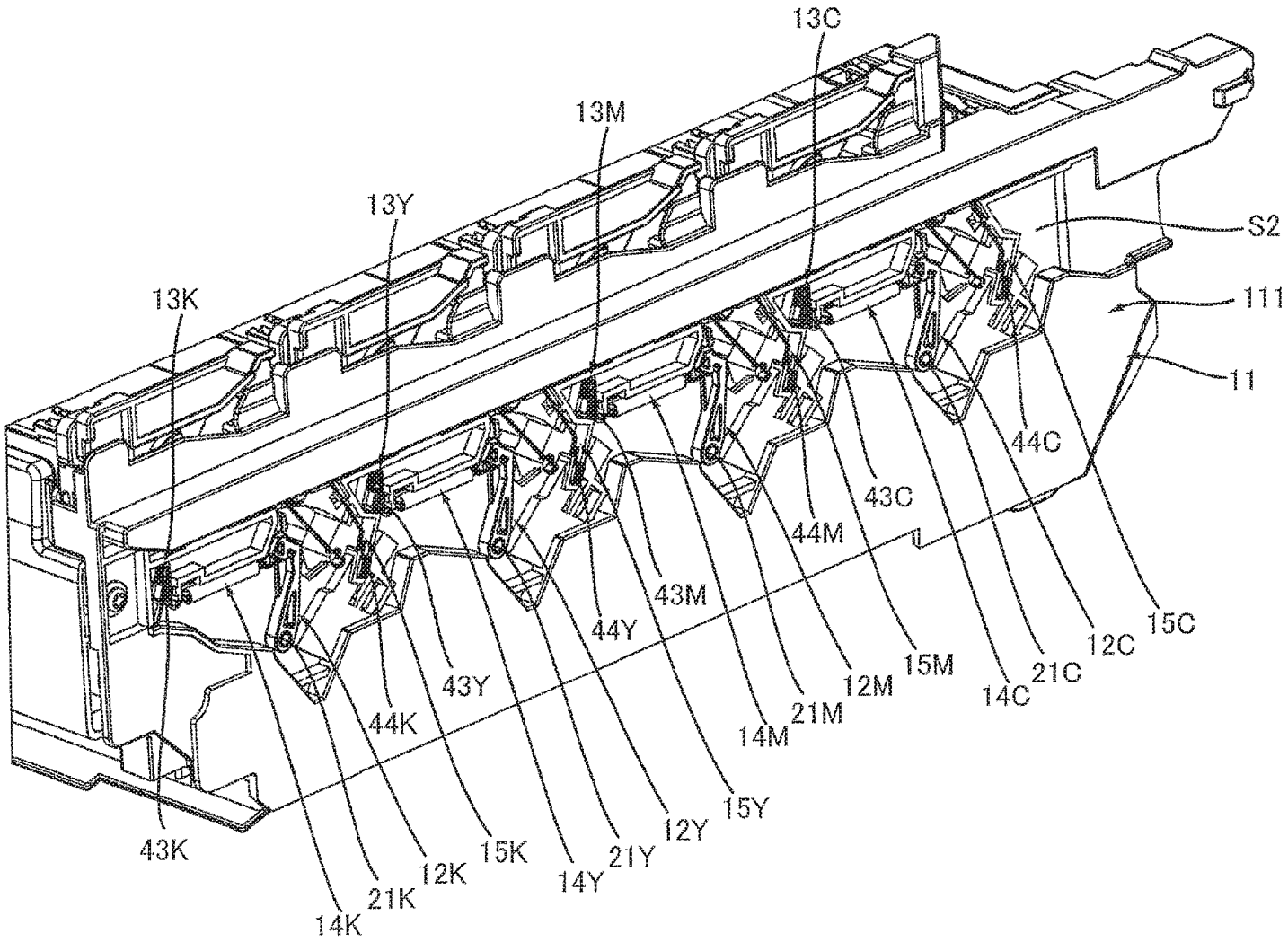
FIG. 3 is a perspective view of a first wall constituting the cartridge support member of FIG. 2, viewed from an outward side of the cartridge support member, FIG. 3 illustrating a state of the first wall from which covers have been removed.

As shown in FIGS. 2 and 3, the cartridge support member 3 includes: a frame 11; a plurality of the levers 12K, 12Y, 12M and 12C; a plurality of the support-member-side developing-bias electrodes 13K, 13Y, 13M and 13C; a plurality of tension springs 14K, 14Y, 14M and 14C; a plurality of connecting members 15K, 15Y, 15M and 15C; a plurality of covers 16K, 16Y, 16M and 16C; and a plurality of lock mechanisms 63K, 63Y, 63M and 63C.

3.1 Frame

The frame 11 is configured to support the photosensitive drums 5K, 5Y, 5M and 5C therein and is further configured to guide the cartridges 4K, 4Y, 4M and 4C when the cartridges 4K, 4Y, 4M and 4C are attached to, or detached from, the cartridge support member 3. The frame 11 includes a first wall 111 and a second wall 112 spaced apart from each other in the drum axial direction. Each of the first wall 111 and the second wall 112 extends in both of: the arrangement direction; and a cartridge attachment/detachment direction in which the cartridges 4K, 4Y, 4M and 4C are attached to, or detached from, the cartridge support member 3. The cartridge attachment/detachment direction intersects with both of the drum-axial direction and the arrangement direction. More preferably, the cartridge attachment/detachment direction is perpendicular to the axial direction, and intersects with the arrangement direction. The first wall 111 supports one end of each of the photosensitive drums 5K, 5Y, 5M and 5C in the drum-axial direction, and the second wall 112 supports the other end of each of the photosensitive drums 5K, 5Y, 5M and 5C in the drum-axial direction. When the cartridges 4K, 4Y, 4M and 4C are supported in the cartridge support member 3, the cartridges 4K, 4Y, 4M and 4C are positioned between the first wall 111 and the second wall 112 in the drum-axial direction.

Figure 4:
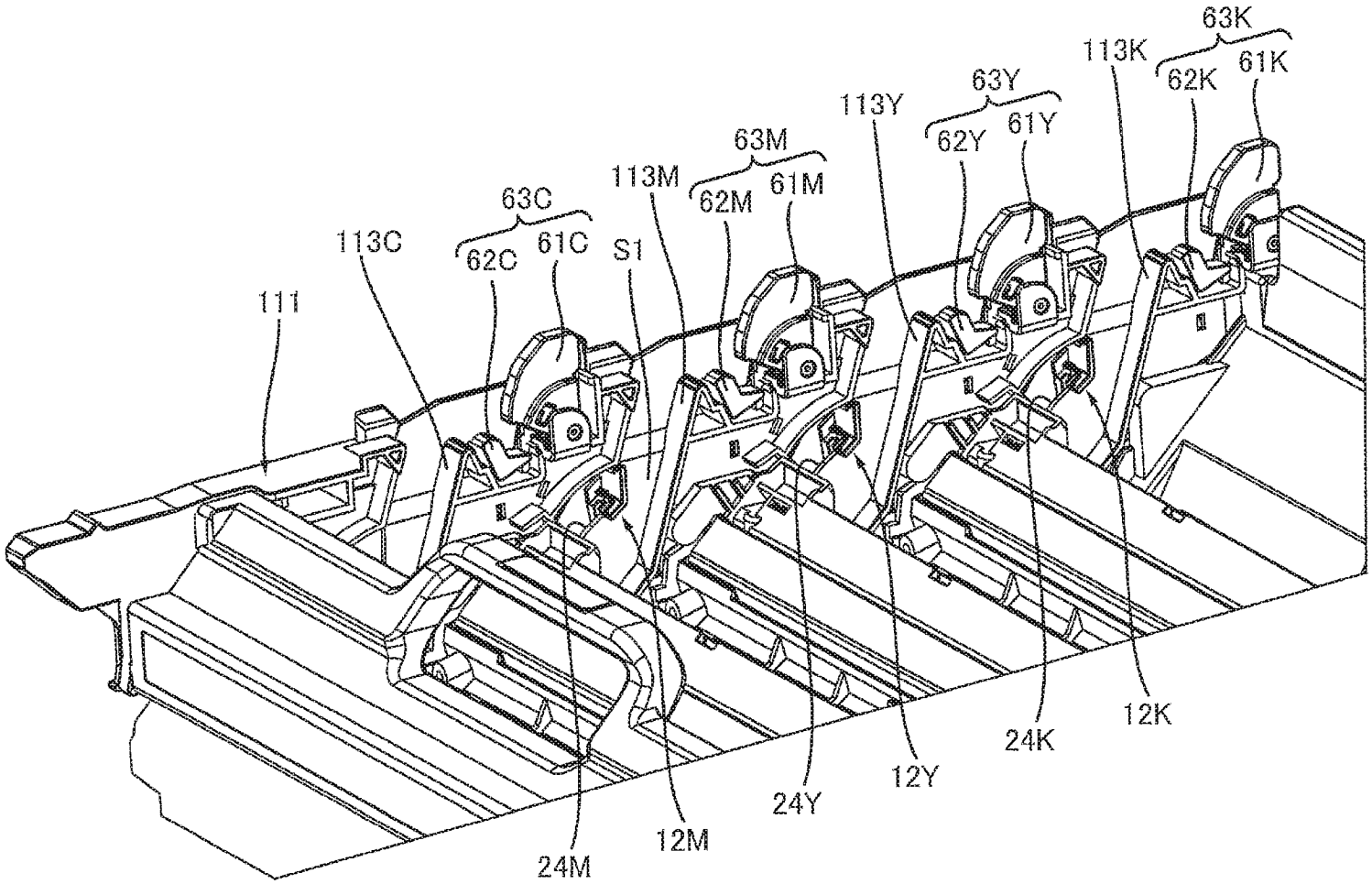
FIG. 4 is a perspective view of the first wall viewed from an inward side of the cartridge support member.

As shown in FIGS. 3 and 4, the first wall 111 includes a first surface S1 and a second surface S2 opposite to each other. In other words, the cartridge support member 3 includes the first surface S1 and the second surface S2.

As shown in FIG. 4, the first surface S1 of the first wall 111 is positioned closer to the second wall 112 (see FIG. 2) than the second surface S2 of the first wall 111 is to the second wall 112. In other words, the first surface S1 is an inward surface of the first wall 111 in the drum-axial direction. The first surface S1 opposes the cartridges 4K, 4Y, 4M and 4C in the drum-axial direction when the cartridges 4K, 4Y, 4M and 4C are supported in the cartridge support member 3. The first surface S1 includes guides 113K, 113Y, 113M and 113C in correspondence with the cartridges 4K, 4Y, 4M and 4C, respectively. The guide 113K is configured to guide the cartridge 4K when the cartridge 4K is inserted into, or pulled out of, the cartridge support member 3. The guide 113Y is configured to guide the cartridge 4Y when the cartridge 4Y is attached to, or detached from, the cartridge support member 3. The guide 113M is configured to guide the cartridge 4M when the cartridge 4M is attached to, or detached from, the cartridge support member 3. The guide 113C is configured to guide the cartridge 4C when the cartridge 4C is attached to, or detached from, the cartridge support member 3. Each of the guides 113K, 113Y, 113M and 113C protrudes from the first surface S1 of the first wall 111 inwardly in the drum-axial direction, and is elongated in the cartridge attachment/detachment direction. Each of the guides 113K, 113Y, 113M and 113C has an elongated plate shape.

As shown in FIG. 3, the second surface S2 of the first wall 111 is disposed at an opposite side of the second wall 112 with respect to the first surface S1 of the first wall 111 in the drum-axial direction. In other words, the second surface S2 of the first wall 111 is an outward surface of the first wall 111 in the drum-axial direction. When the cartridges 4K, 4Y, 4M and 4C are supported in the cartridge support member 3, the second surface S2 of the first wall 111 is disposed at the opposite side of the cartridges 4K, 4Y, 4M and 4C with respect to the first surface S1 of the first wall 111 in the drum-axial direction.

As shown in FIG. 4, the first wall 111 is formed with openings 24K, 24Y, 24M, and 24C that penetrate the first wall 111 at positions in correspondence with the levers 12K, 12Y, 12M, and 12C, respectively. That is, each of the openings 24K, 24Y, 24M, and 24C is formed at a position next to the corresponding guide 113K, 113Y, 113M and 113C in the arrangement direction.

As shown in FIG. 2, the second wall 112 includes guides 114K, 114Y, 114M and 114C for guiding the cartridges 4K, 4Y, 4M and 4C, respectively. The guides 114K, 114Y, 114M and 114C are disposed on an inward surface of the second wall 112 in the drum-axial direction.

As shown in FIG. 4, the lock mechanisms 63K, 63Y, 63M and 63C are provided on the first surface S1 of the first wall 111. The lock mechanism 63K includes a first lock member 61K and a second lock member 62K. The lock mechanism 63Y includes a first lock member 61Y and a second lock member 62Y. The lock mechanism 63M includes a first lock member 61M and a second lock member 62M. The lock mechanism 63C includes a first lock member 61C and a second lock member 62C. The lock mechanisms 63K, 63Y, 63M and 63C are configured to lock the cartridges 4K, 4Y, 4M and 4C, respectively, to the cartridge support member 3.

Figure 6:
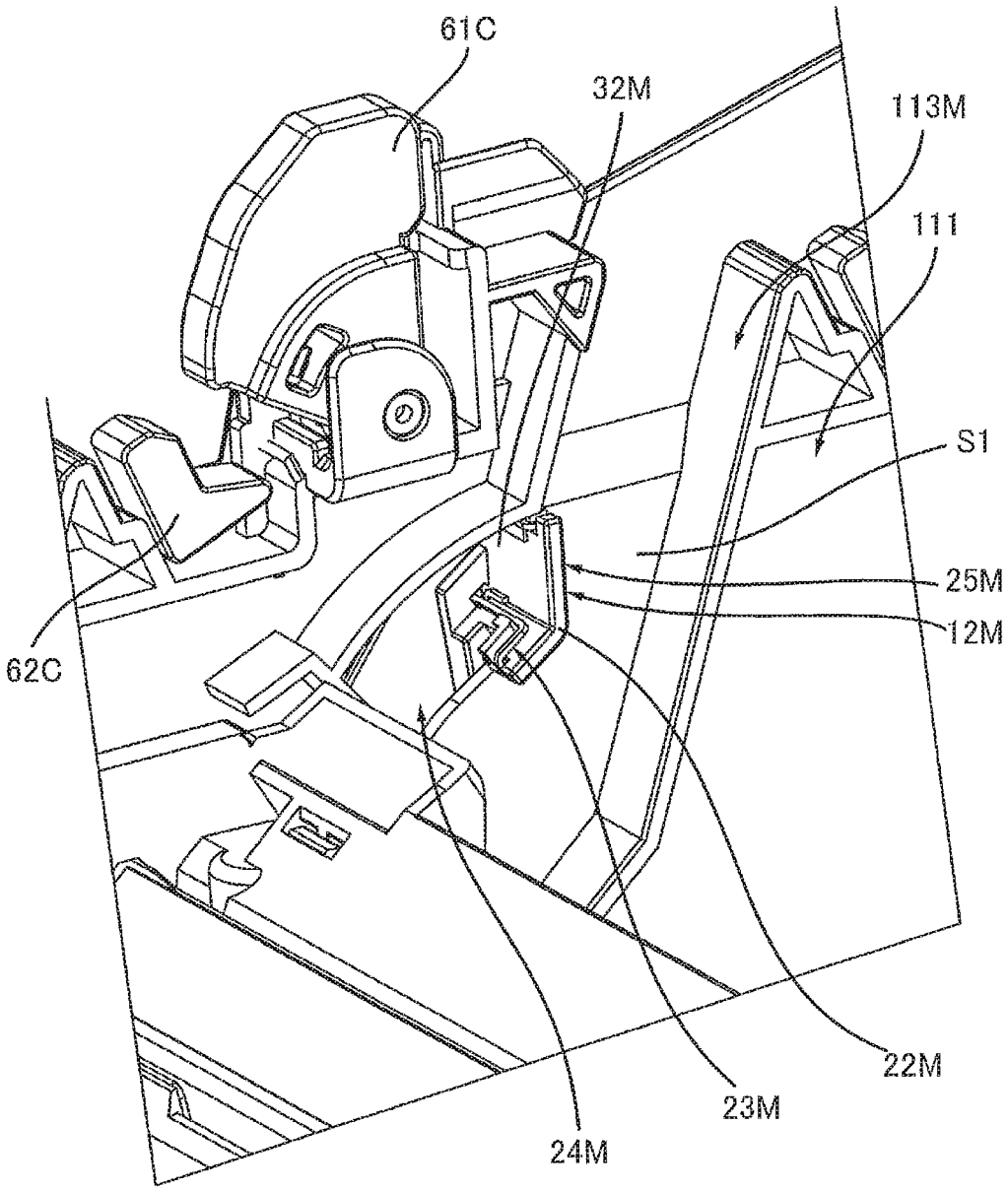
FIG. 6 is an enlarged view of an essential part of the perspective view in FIG. 4, illustrating how a protrusion provided at a distal end of the lever is inserted into an opening of the first wall and protrudes from a second surface side of the first wall to a first surface side of the first wall.

The lock mechanisms 63K, 63Y, 63M and 63C have the same configuration with one another. Accordingly, configuration of the lock mechanism 63C will be described below with reference to FIG. 6. As shown in FIG. 6, the first lock member 61C and the second lock member 62C are provided on the cartridge support member 3 such that the first lock member 61C and the second lock member 62C are spaced apart from each other in the arrangement direction. The first lock member 61C is pivotally movable relative to the cartridge support member 3 in a direction to approach the second lock member 62C and in another direction to move away from the second lock member 62C. The first lock member 61C is biased by a spring (not shown) to approach the second lock member 62C.

Figure 9:
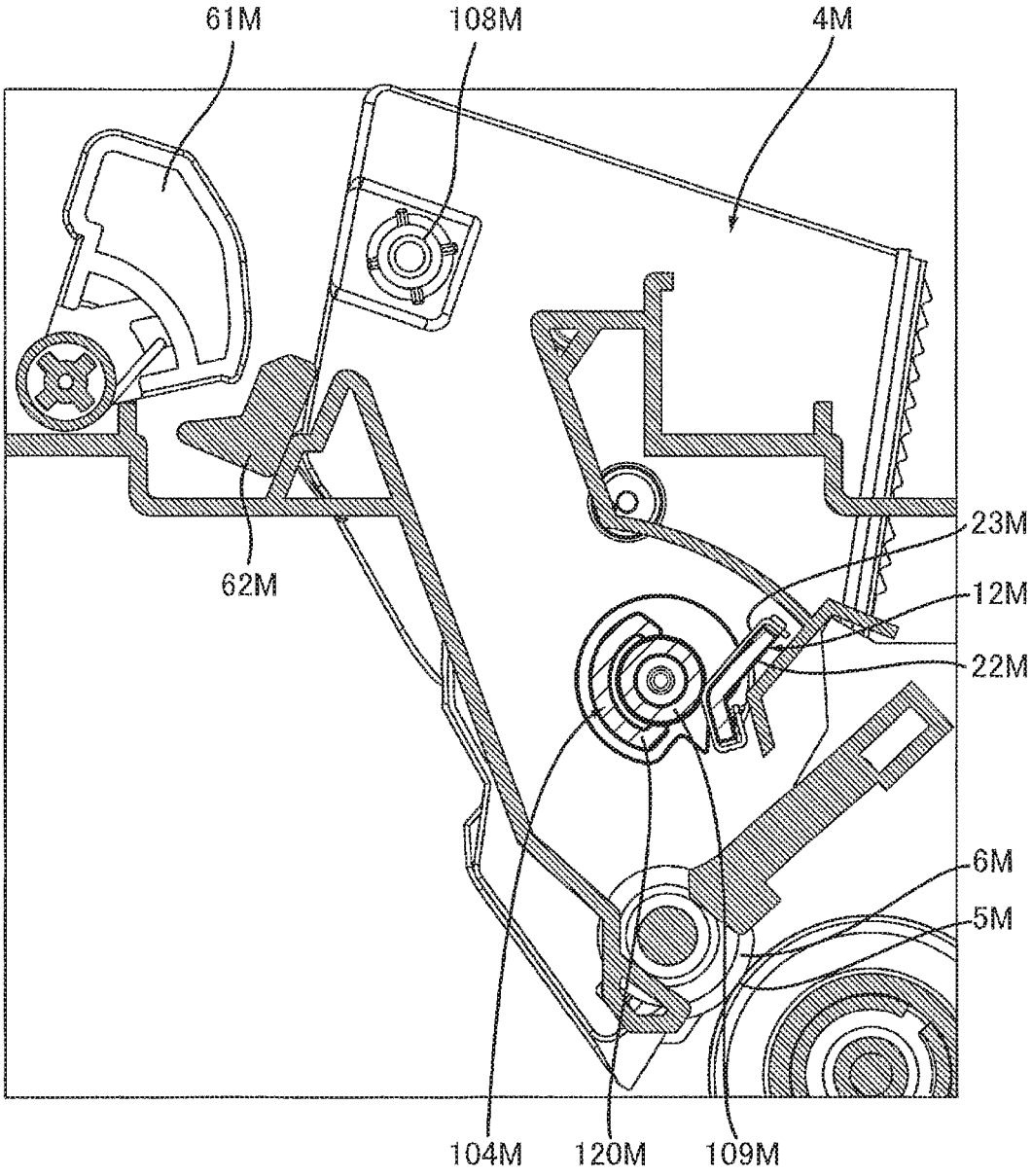

Next will be described with reference to FIGS. 9 and 11 the manner how the cartridge 4M is locked by the lock mechanism 63M.

The cartridge 4M is movable between a locked position (see FIG. 11) and an unlocked position (see FIG. 9) while the cartridge 4M remains being supported by the cartridge support member 3. When the cartridge 4M is at the locked position, the cartridge 4M is locked to the cartridge support member 3. More specifically, the cartridge 4M is locked to the cartridge support member 3 by the boss 108M of the cartridge 4M being clamped between the first lock member 61M and the second lock member 62M as shown in FIG. 11. The locked state of the cartridge 4M relative to the cartridge support member 3 is released when the cartridge 4M moves to the unlocked position. More precisely, as shown in FIG. 9, the locked state of the cartridge 4M with respect to the cartridge support member 3 is released when the boss 108M of the cartridge 4M moves out of the gap between the first lock member 61M and the second lock member 62M.

As shown in FIGS. 2 and 3, on the second surface S2 of the first wall 111, there are provided: the support-member-side developing-bias electrodes 13K, 13Y, 13M and 13C; the tension springs 14K, 14Y, 14M and 14C; the levers 12K, 12Y, 12M and 12C; the connecting members 15K, 15Y, 15M and 15C; and the covers 16K, 16Y, 16M and 16C.

3.2 Levers

As shown in FIG. 3, the levers 12K, 12Y, 12M and 12C are pivotally movably supported by the first wall 111. Because the levers 12K, 12Y, 12M and 12C are provided on the second surface S2 that is opposite to the first surface S1 on which the guides 113K, 113Y, 113M and 113C are provided, it is ensured that the levers 12K, 12Y, 12M and 12C will not interfere with the cartridges 4K, 4Y, 4M and 4C when the cartridges 4K, 4Y, 4M and 4C are attached to, or detached from, the cartridge support member 3. The levers 12K, 12Y, 12M and 12C are arranged in the arrangement direction with intervals therebetween.

The levers 12K, 12Y, 12M and 12C have the same configuration with one another. Therefore, the lever 12M will be described below as a representative example of the levers 12K, 12Y, 12M and 12C.

3.2.1 Position of the Lever

Figure 10:
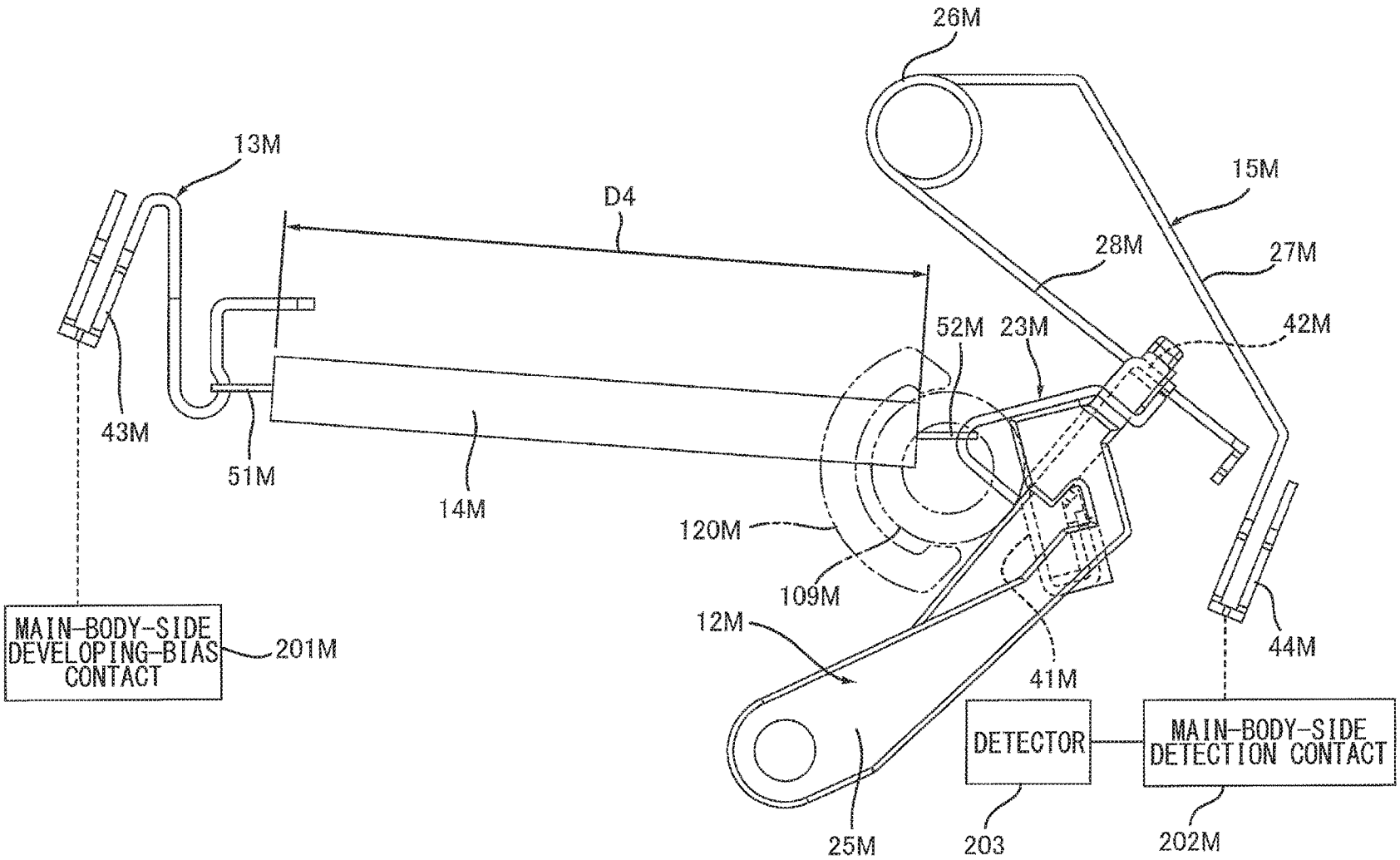

The lever 12M can be located at either one of: a first position (FIG. 12); a second position (FIG. 14); a third position (FIG. 7); and a fourth position (FIG. 10), which are different from one another.

More specifically, while the cartridge 4M is not supported by the cartridge support member 3, the lever 12M stays at the third position due to the pulling force of the tension spring 14M as shown in FIG. 7. When the cartridge 4M becomes supported by the cartridge support member 3 and disposed at the unlocked position, the lever 12M moves from the third position to the fourth position shown in FIG. 10 upon abutment contact with the shaft 109M of the cartridge 4M. While the cartridge 4M remains supported by the cartridge support member 3, when the cartridge 4M moves from the unlocked position to the locked position, the lever 12M moves from the fourth position to the first position shown in FIG. 12, while maintaining the contact with the shaft 109M. While the cartridge 4M remains supported by the cartridge support member 3 and stays at the locked position, when the detecting protrusion 120M of the cartridge 4M is brought into abutment contact with the lever 12M, the lever 12M moves from the first position to the second position shown in FIG. 14.

3.2.2 Structure of the Lever

Figure 5:
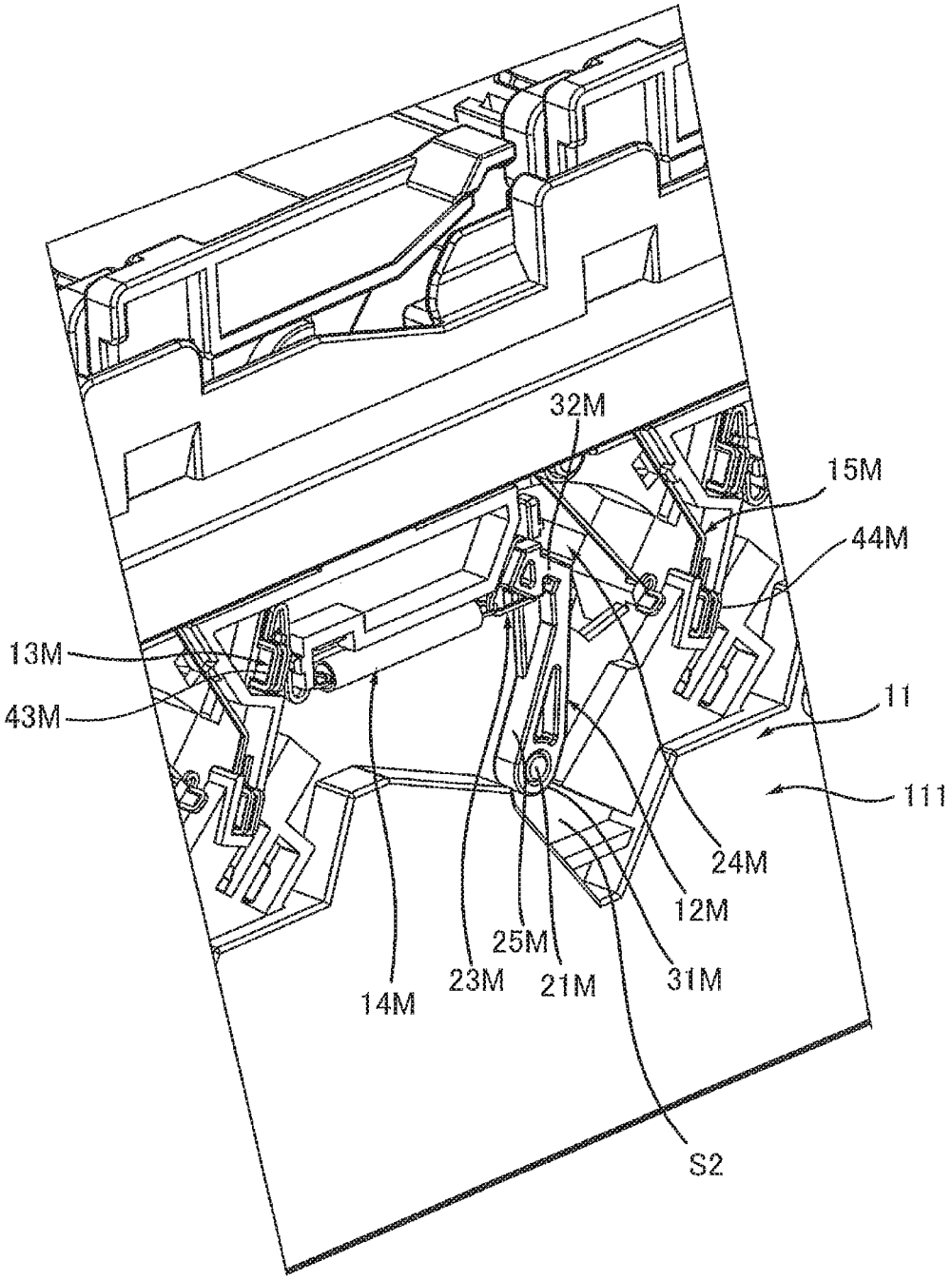
FIG. 5 is an enlarged view of an essential part of the perspective view in FIG. 3, illustrating how a support-member-side developing-bias electrode, a tension spring, a lever, and a connecting member for a magenta-toner cartridge are arranged on a second surface of the first wall.

As shown in FIGS. 5 and 7, the lever 12M includes: a lever body 25M; and an electrode 23M. The lever body 25M is pivotally movably supported by the frame 11. In other words, the lever 12M is pivotally movably supported by the frame 11. More specifically, the cartridge support member 3 includes a boss 21M having a cylindrical shape protruding from the second surface S2 in the drum-axial direction. The lever body 25M extends in the radius direction of the boss 21M and along the second surface S2 of the first wall 111. The lever body 25M includes a base end 31M and a distal end 32M in the direction in which the lever body 25M extends such that the distal end 32M is apart from the base end 31M in the direction the lever body 25M extends. The lever body 25M is attached, at the base end 31M, to the boss 21M such that the lever 12M is pivotally movable about the boss 21M. When the lever 12M pivotally moves, the distal end 32M of the lever 12M moves in the arrangement direction. The lever body 25M is formed of electrically insulating material such as resin. The lever body 25M includes a protrusion 22M at the distal end 32M as shown in FIG. 6. The protrusion 22M protrudes from the distal end 32M of the lever body 25M, which is disposed at the second surface S2 side of the first wall 111, inward in the drum-axial direction. The protrusion 22M is inserted into the opening 24M of the first wall 111 to reach a position further inward of the first surface S1 of the first wall 111 in the drum-axial direction. A portion of the protrusion 22M that is disposed further inward of the first surface S1 of the first wall 111 in the drum-axial direction therefore opposes the guide 113M in the arrangement direction.

As shown in FIGS. 5 and 6, the electrode 23M is attached to the distal end 32M of the lever body 25M such that a portion of the electrode 23M is disposed on the protrusion 22M. The electrode 23M is a bent wire formed of electrically conductive material such as metal. As shown in FIGS. 9-12, the part of the electrode 23M that is disposed on the protrusion 22M contacts the circumferential surface of the shaft 109M of the cartridge 4M when the cartridge 4M is inserted into the cartridge support member 3. The part of the electrode 23M that contacts the shaft 109M serves as a lever-side developing-bias contact 41M. The portion of the circumferential surface of the shaft 109M that contacts the electrode 23M serves as the cartridge-side developing-bias contact 45M. Thus, the lever-side developing-bias contact 41M and the cartridge-side developing-bias contact 45M are configured so as to be electrically connected with each other.

Figure 14:
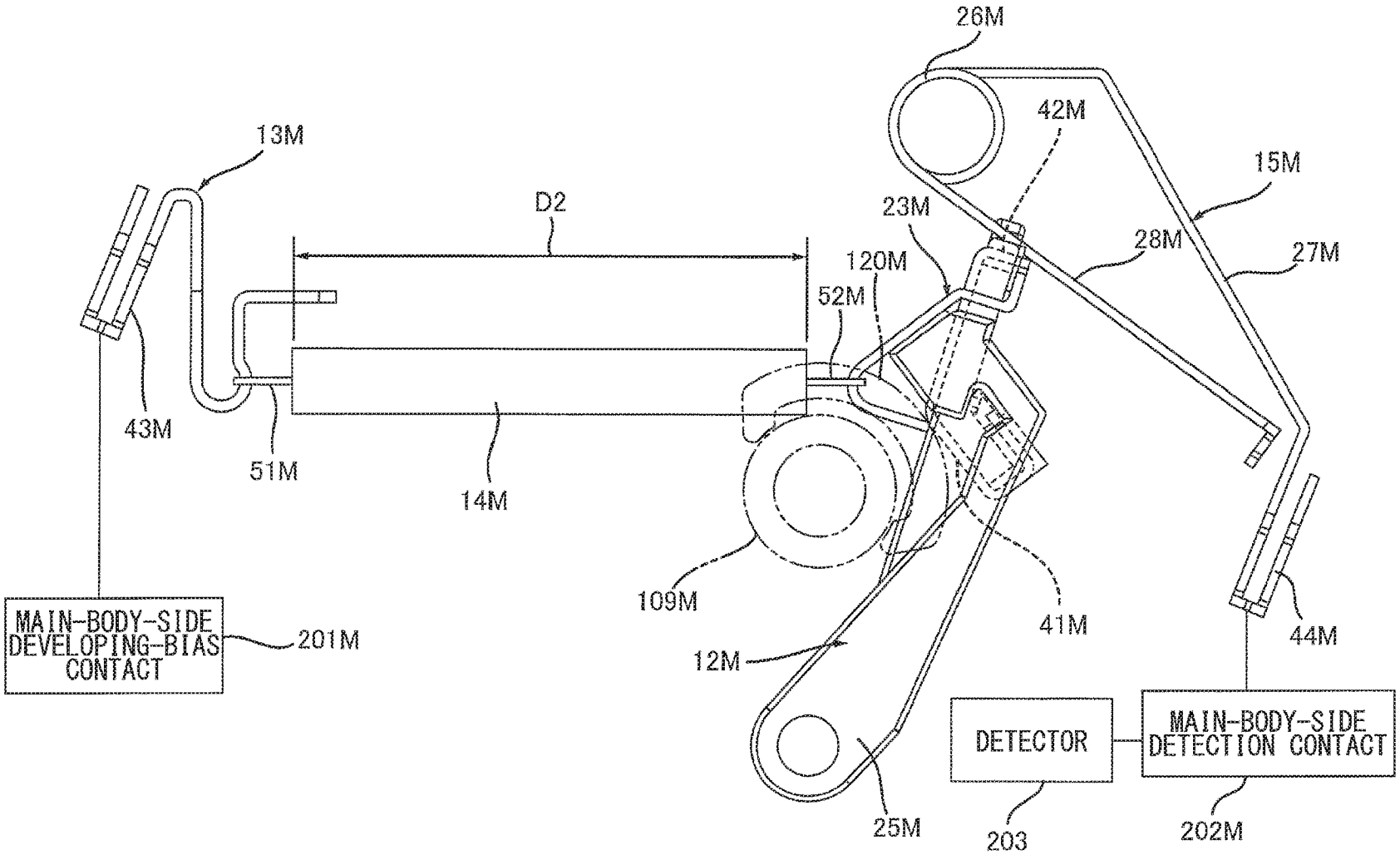

Further, as shown in FIG. 14, when the cartridge 4M supported in the cartridge support member 3 becomes disposed at the locked position, the electrode 23M is brought into abutment contact with the connecting member 15M at a portion of the electrode 23M that is different from the lever-side developing-bias contact 41. That is, when the lever 12M becomes disposed at the second position, the electrode 23M contacts the connecting member 15M at a portion of the electrode 23M that is different from the lever-side developing-bias contact 41M. The portion of the electrode 23M that contacts the connecting member 15M serves as the support-member-side detection contact 42M. Namely, the electrode 23M includes both of the lever-side developing-bias contact 41M and the support-member-side detection contact 42M. In other words, the lever 12M includes both of the lever-side developing-bias contact 41M and the support-member-side detection contact 42M.

3.3 Support-Member-Side Developing-Bias Electrodes

As shown in FIGS. 2 and 3, the support-member-side developing-bias electrodes 13K, 13Y, 13M and 13C are fixedly secured to the second surface S2 of the first wall 111 in the frame 11 such that the support-member-side developing-bias electrodes 13K, 13Y, 13M and 13C are arranged in the arrangement direction with intervals therebetween. While the cartridge support member 3 remains at the inside position, the support-member-side developing-bias electrode 13K remains in contact with the main-body-side developing-bias contact 201K so as to be in electrical connection with the main-body-side developing-bias contact 201K, the support-member-side developing-bias electrode 13Y remains in contact with the main-body-side developing-bias contact 201Y so as to be in electrical connection with the main-body-side developing-bias contact 201Y, the support-member-side developing-bias electrode 13M remains in contact with the main-body-side developing-bias contact 201M so as to be in electrical connection with the main-body-side developing-bias contact 201M, and the support-member-side developing-bias electrode 13C remains in contact with the main-body-side developing-bias contact 201C so as to be in electrical connection with the main-body-side developing-bias contact 201C.

The support-member-side developing-bias electrodes 13K, 13Y, 13M and 13C have the same structure with one another. Therefore, the support-member-side developing-bias electrode 13M will be described below as a representative example of the support-member-side developing-bias electrodes 13K, 13Y, 13M and 13C.

As shown in FIGS. 5 and 7, the support-member-side developing-bias electrode 13M is disposed at an opposite side of the connecting member 15M with respect to the lever 12M in the arrangement direction. The support-member-side developing-bias electrode 13M is a bent wire formed of electrically conductive material such as metal. The support-member-side developing-bias electrode 13M includes an electric contact 43M. While the cartridge support member 3 remains at the inside position, the electric contact 43M remains in contact with the main-body-side developing-bias contact 201M, thereby maintaining electrical connection with the main-body-side developing-bias contact 201M.

3.4 Tension Springs

As shown in FIG. 3, the tension springs 14K, 14Y, 14M and 14C are provided on the second surface S2 of the frame 11 such that the tension springs 14K, 14Y, 14M and 14C are arranged in the arrangement direction with intervals therebetween.

As shown in FIG. 3, the tension springs 14K, 14Y, 14M and 14C have the same configuration with one another. Therefore, the tension spring 14M will be described below as a representative example of the tension springs 14K, 14Y, 14M and 14C.

As shown in FIGS. 5 and 7, the tension spring 14M is disposed at a position between the support-member-side developing-bias electrode 13M and the lever 12M in the arrangement direction. The tension spring 14M extends in the arrangement direction. The tension spring 14M is made of electrically conductive material such as metal. As shown in FIG. 7, the tension spring 14M includes a first end 51M and a second end 52M spaced apart from each other in the arrangement direction. The tension spring 14M is connected at the first end 51M to the support-member-side developing-bias electrode 13M. That is, the first end 51M of the tension spring 14M is attached to the frame 11 via the support-member-side developing-bias electrode 13M. The tension spring 14M is connected at the second end 52M to the electrode 23M of the lever 12M. That is, the tension spring 14M is in contact with the support-member-side developing-bias electrode 13M at the first end 51M thereof, and is in contact with the electrode 23M at the second end 52M thereof. The tension spring 14M thus electrically connects the support-member-side developing-bias electrode 13M to the electrode 23M of the lever 12M. The distance between the first end 51M and the second end 52M of the tension spring 14M when the lever 12M is at the second position (D2 in FIG. 14) is longer than the distance between the first end 51M and the second end 52M of the tension spring 14M when the lever 12M is at the first position (D1 in FIG. 12). Further, the distance between the first end 51M and the second end 52M of the tension spring 14M when the lever 12M is at the third position (D3 in FIG. 7) is shorter than the distance between the first end 51M and the second end 52M of the tension spring 14M when the lever 12M is at the first position (D1 in FIG. 12). Moreover, the distance between the first end 51M and the second end 52M of the tension spring 14M when the lever 12M is at the fourth position (D4 in FIG. 10) is longer than the distance between the first end 51M and the second end 52M of the tension spring 14M when the lever 12M is at the second position (D2 in FIG. 14).

3.5 Connecting Members

As shown in FIGS. 2 and 3, the connecting members 15K, 15Y, 15M and 15C are provided on the second surface S2 of the first wall 111 such that the connecting members 15K, 15Y, 15M and 15C are arranged in the arrangement direction with intervals therebetween.

While the cartridge support member 3 remains at the inside position, the connecting member 15K is in contact with the main-body-side detection contact 202K so as to be in electrical connection with the main-body-side detection contact 202K, the connecting member 15Y is in contact with the main-body-side detection contact 202Y so as to be in electrical connection with the main-body-side detection contact 202Y, the connecting member 15M is in contact with the main-body-side detection contact 202M so as to be in electrical connection with the main-body-side detection contact 202M, and the connecting member 15C is in contact with the main-body-side detection contact 202C so as to be in electrical connection with the main-body-side detection contact 202C. The detector 203 detects that the main-body-side detection contact 202K is electrically connected to the support-member-side detection contact 42K when an electric current flows in the main-body-side detection contact 202K. The detector 203 detects that the main-body-side detection contact 202Y is electrically connected to the support-member-side detection contact 42Y when an electric current flows in the main-body-side detection contact 202Y. The detector 203 detects that the main-body-side detection contact 202M is electrically connected to the support-member-side detection contact 42M when an electric current flows in the main-body-side detection contact 202M. The detector 203 detects that the main-body-side detection contact 202C is electrically connected to the support-member-side detection contact 42C when an electric current flows in the main-body-side detection contact 202C.

As shown in FIG. 3, the connecting members 15K, 15Y, 15M and 15C have the same structure with one another. Therefore, the lever 15M will be described below as a representative example of the connecting members 15K, 15Y, 15M and 15C.

As shown in FIGS. 5 and 7, the connecting member 15M is disposed at an opposite side of the tension spring 14M with respect to the lever 12M in the attachment direction. The connecting member 15M is a bent wire formed of electrically conductive material such as metal. The connecting member 15M includes: a connection part 26M; a first part 27M; and a second part 28M.

The connection part 26M connects the first part 27M and second part 28M with each other. The connection part 26M has a cylindrical shape whose axis extends in the drum-axial direction. More specifically, the connection part 26M is a coil formed of a spiral wire.

The first part 27M and the second part 28M are arranged in the arrangement direction, that is, in a direction in which the lever 12M moves (which will be referred to also as "lever-moving direction" hereinafter). The first part 27M and the second part 28M are spaced apart from each other in the arrangement direction, that is, in the lever-moving direction. The first part 27M is disposed at an opposite side of the lever 12M with respect to the second part 28M in the arrangement direction, that is, in the lever-moving direction.

The first part 27M of the connecting member 15M is fixedly secured to the frame 11 such that the first part 27M extends in a direction intersecting with the lever-moving direction. The first part 27M includes a base end and a distal end spaced apart from each other in a direction in which the first part 27M extends. The first part 27M is connected, at its base end, to the connection part 26M. The first part 27M is in contact with the main-body-side detection contact 202M at its distal end, while the cartridge support member 3 remains at the inside position. The first part 27M includes an electric contact 44M at its distal end. The electric contact 44M remains in contact with the main-body-side detection contact 202M, while the cartridge support member 3 stays at the inside position. Thus, the connecting member 15M is in electrical connection with the main-body-side detection contact 202M, while the cartridge support member 3 stays at the inside position.

The second part 28M of the connecting member 15M is disposed between the lever 12M and the first part 27M of the connecting member 14M in the lever-moving direction. The second part 28M extends in a direction intersecting with the lever-moving direction. The second part 28M includes a base end and a distal end spaced apart from each other in the direction in which the second part 28M extends. The second part 28M is connected at its base end to the connection part 26M. In this manner, the base end of the second part 28M is connected to the base end of the first part 27M via the connection part 26M. The distal end of the second part 28M is spaced away from the distal end of the first part 27M in the lever-moving direction. As shown in FIGS. 12 and 14, the second part 28M of the connecting member 15 is movable such that the distal end of the second part 28M approaches the first part 27M in the lever-moving direction. More specifically, the second part 28M of the connecting member 15 moves in the lever-moving direction to approach the first part 27M when the electrode 23M of the lever 12M is brought into abutment contact with the second part 28M of the connecting member 15. In other words, the second part 28M moves in the lever-moving direction to approach the first part 27M when the electrode 23M of the lever 12M is brought into contact with the second part 28M. The connecting member 15M is deformed resiliently when the second part 28M of the connecting member 15 approaches the first part 27M of the connecting member 15. When the electrode 23M is separated away from the connecting member 15M, the connecting member 15 restores its original shape by virtue of its internal stress. Thus, the connecting member 15M serves as a wired spring.

Also when the electrode 23M is brought into abutment contact with the second part 28M of the connecting member 15M, the connecting member 15M becomes electrically connected to the support-member-side developing-bias electrode 13M via the tension spring 14M and the electrode 23M of the lever 12M.

3.6 Covers

As shown in FIGS. 2 and 3, the covers 16K, 16Y, 16M and 16C are fixedly secured to the second surface S2 of the first wall 111. The covers 16K, 16Y, 16M and 16C are arranged in the arrangement direction.

The cover 16K is disposed such that the support-member-side developing-bias electrode 13K, the tension spring 14K, the lever 12K, and the connecting member 15K are interposed between the second surface S2 of the first wall 111 and the cover 16K in the drum-axial direction. The cover 16K covers the entire part of the tension spring 14K, and covers the entire part of the lever 12K. The cover 16K covers only a portion of the support-member-side developing-bias electrode 13K, and covers only a portion of the connecting member 15K. More specifically, as shown in FIG. 2, the cover 16K has: an opening exposing the electric contact 43K of the support-member-side developing-bias electrode 13K; and an opening exposing the electric contact 44K of the connecting member 15M.

The cover 16Y is disposed such that the support-member-side developing-bias electrode 13Y, the tension spring 14Y, the lever 12Y, and the connecting member 15Y are interposed between the second surface S2 of the first wall 111 and the cover 16Y in the drum-axial direction. The cover 16Y covers the entire part of the tension spring 14Y, and covers the entire part of the lever 12Y. The cover 16Y covers only a portion of the support-member-side developing-bias electrode 13Y, and covers only a portion of the connecting member 15Y. More specifically, as shown in FIG. 2, the cover 16Y has: an opening exposing the electric contact 43Y of the support-member-side developing-bias electrode 13Y; and an opening exposing the electric contact 44Y of the connecting member 15Y.

The cover 16M is disposed such that the support-member-side developing-bias electrode 13M, the tension spring 14M, the lever 12M, and the connecting member 15M are interposed between the second surface S2 of the first wall 111 and the cover 16M in the drum-axial direction. The cover 16M covers the entire part of the tension spring 14M, and covers the entire part of the lever 12M. The cover 16M covers only a portion of the support-member-side developing-bias electrode 13M, and covers only a portion of the connecting member 15M. More specifically, as shown in FIG. 2, the cover 16M has: an opening exposing the electric contact 43M of the support-member-side developing-bias electrode 13M; and an opening exposing the electric contact 44M of the connecting member 15M.

The cover 16C is disposed such that the support-member-side developing-bias electrode 13C, the tension spring 14C, the lever 12C, and the connecting member 15C are interposed between the second surface S2 of the first wall 111 and the cover 16C in the drum-axial direction. The cover 16C covers the entire of the tension spring 14C, and covers the entire of the lever 12C. The cover 16C covers only a portion of the support-member-side developing-bias electrode 13C, and covers only a portion of the connecting member 15C. More specifically, as shown in FIG. 2, the cover 16C has: an opening exposing the electric contact 43C of the support-member-side developing-bias electrode 13C; and an opening exposing the electric contact 44C of the connecting member 15C.

Because the covers 16K, 16Y, 16M and 16C partially cover the corresponding connecting members 15K, 15Y, 15M and 15C, respectively, this reduces the possibility that the connecting members 15K, 15Y, 15M and 15C interfere with the main-body-side detection contacts 202K, 202Y, 202M and 202C during the process of moving the cartridge support member 3 between the inside position and the outside position.

4. Insertion of the Cartridge into the Cartridge Support Member

Next will be described, with reference to FIGS. 7 and 9 to 12, how the cartridge 4M is attached to the cartridge support member 3. Note that the other remaining cartridges 4K, 4Y and 4C are attached to the cartridge support member 3 in the same manner as the cartridge 4M is. Thus, the insertion of the cartridge 4M to the cartridge support member 3 will be described below.

While the cartridge 4M is not supported in the cartridge support member 3, the lever 12M stays at the third position as shown in FIG. 7. While staying at the third position, the lever 12M is located apart from the connecting member 15M.

While the cartridge support member 3 remains at the outside position, the user attaches the cartridge 4M to the cartridge support member 3. As a result, the cartridge 4M becomes disposed at the unlocked position with respect to the cartridge support member 3 as shown in FIG. 9. The circumferential surface of the shaft 109M of the cartridge 4M is brought into abutment contact with the lever 12M, whereupon the lever 12M moves from the third position to the fourth position shown in FIG. 10. When the lever 12M reaches the fourth position, the lever 12M is brought into abutment contact with the second part 28M of the connecting member 15M. The connecting member 15M is deformed such that the second part 28M of the connecting member 15M approaches the first part 27M of the connecting member 15M.

That is, when the user attaches the cartridge 4M to the cartridge support member 3, the lever 12M and the connecting member 15M interfere with each other. The connecting member 15M is configured such that the distal end of the second part 28M functions as a free end and the second part 28M is movable so as to approach the first part 27M. Accordingly, this configuration can prevent the connecting member 15M from being broken during the process of attaching the cartridge 4M to the cartridge support member 3.

Figure 11:
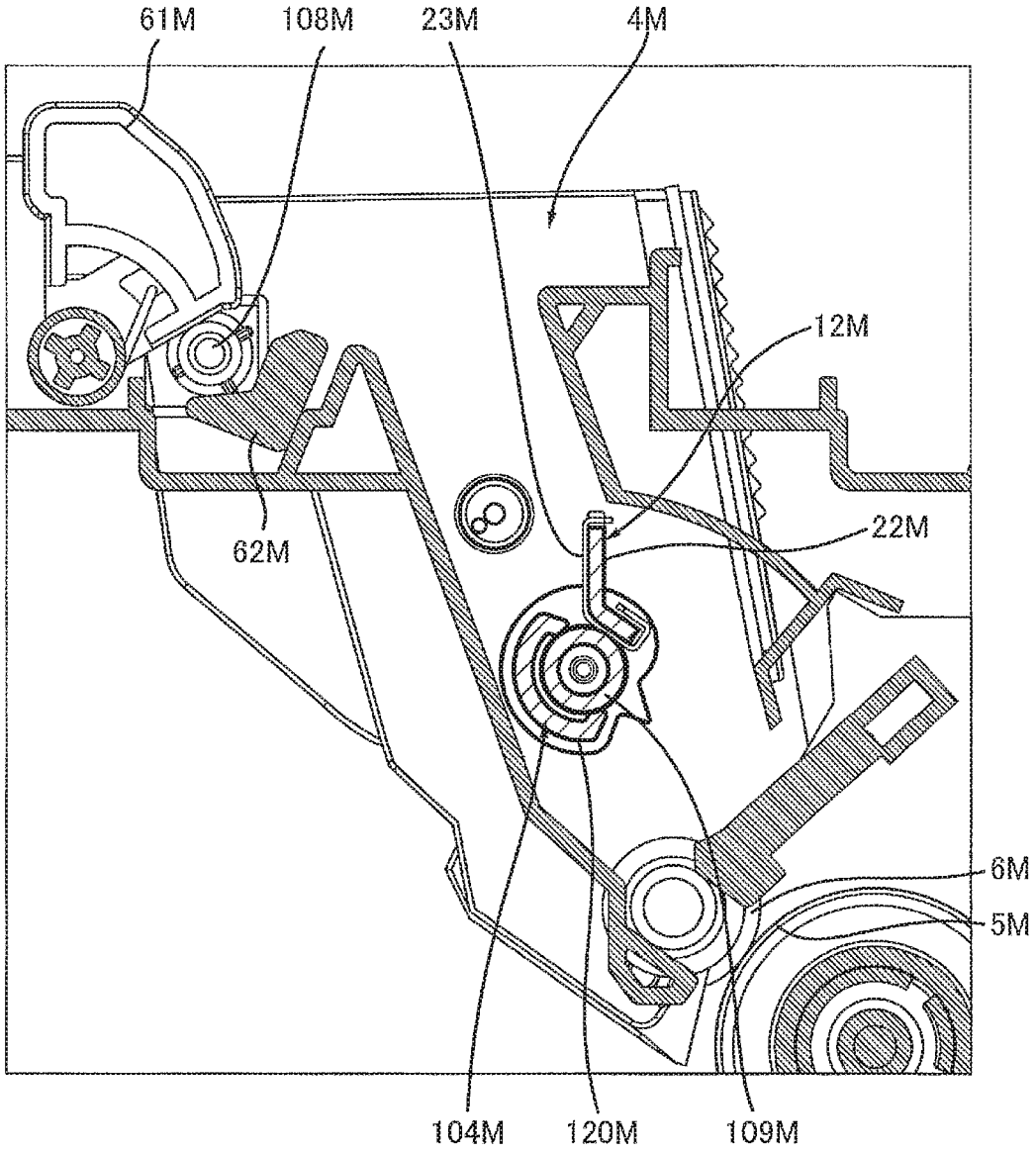

While the cartridge support member 3 remains at the outside position, the user moves the cartridge 4M from the unlocked position to the locked position shown in FIG. 11. The shaft 109M of the cartridge 4M moves in a direction away from the connecting member 15M. In association with this movement of the shaft 109M, the lever 12M is pulled by the tension spring 14M to move in the direction away from the connecting member 15M as shown in FIG. 12, while maintaining the contact with the shaft 109M. As a result, the lever 12M moves from the fourth position to the first position.

In this state, the user moves the cartridge support member 3 from the outside position toward the inside position. When the cartridge support member 3 reaches the inside position, the electric contact 43M of the support-member-side developing-bias electrode 13M is brought into contact with the main-body-side developing-bias contact 201M so as to be electrically connected to the main-body-side developing-bias contact 201M. In this way, when the cartridge support member 3 having the cartridge 4M held therein reaches the inside position, the lever 12M electrically connects the main-body-side developing-bias contact 201M to the cartridge-side developing-bias contact 45M. The developing bias is applied from the main-body-side developing-bias contact 201M to the shaft 109M of the cartridge 4M through the support-member-side developing-bias electrode 13M, tension spring 14M and electrode 23M. It is noted that the electric contact 44M of the connecting member 15M is electrically connected with the main-body-side detection contact 202M. However, as long as the lever 12M stays at the first position, the support-member-side detection contact 42M is not electrically connected with the main-body-side detection contact 202M because the lever 12M at the first position is disposed apart from the connecting member 15M.

It is also noted that the main-body-side developing-bias contact 201M and the cartridge-side developing-bias contact 45M are indispensable for applying the developing bias to the developing roller 6M. By employing the configuration that the lever 12M electrically connects the main-body-side developing-bias contact 201M to the cartridge-side developing-bias contact 45M, the developing bias applied from the main-body-side developing-bias contact 201M can be utilized by the detector 203 to detect whether the support-member-side detection contact 42M is electrically connected with the main-body-side detection contact 202M. Hence, no additional power supplies need to be provided to detect the electrical connection between the support-member-side detection contact 42M and the main-body-side detection contact 202M.

5. Operation of the Image Forming Apparatus

Next will be described with reference to FIGS. 11 to 14 how the image forming apparatus 1 operates.

While the cartridge support member 3 is at the inside position with the cartridges 4K, 4Y, 4M and 4C being held in the cartridge support member 3 at the locked position as shown in FIGS. 11 and 12, the image forming apparatus 1 reads information on the cartridges 4K, 4Y, 4M and 4C. The information on the cartridges 4K, 4Y, 4M and 4C is read in the same manner as one another. Therefore, next will be described how information is read from the cartridge 4M.

To read information from the cartridge 4M, a drive force is inputted from the drive power source 211 through the main-body-side coupling 210M to the coupling 107M of the cartridge 4M (see FIG. 8). The detecting protrusion 120M is rotated around the shaft 109M by the drive force inputted from the drive power source 211.

Figure 13:
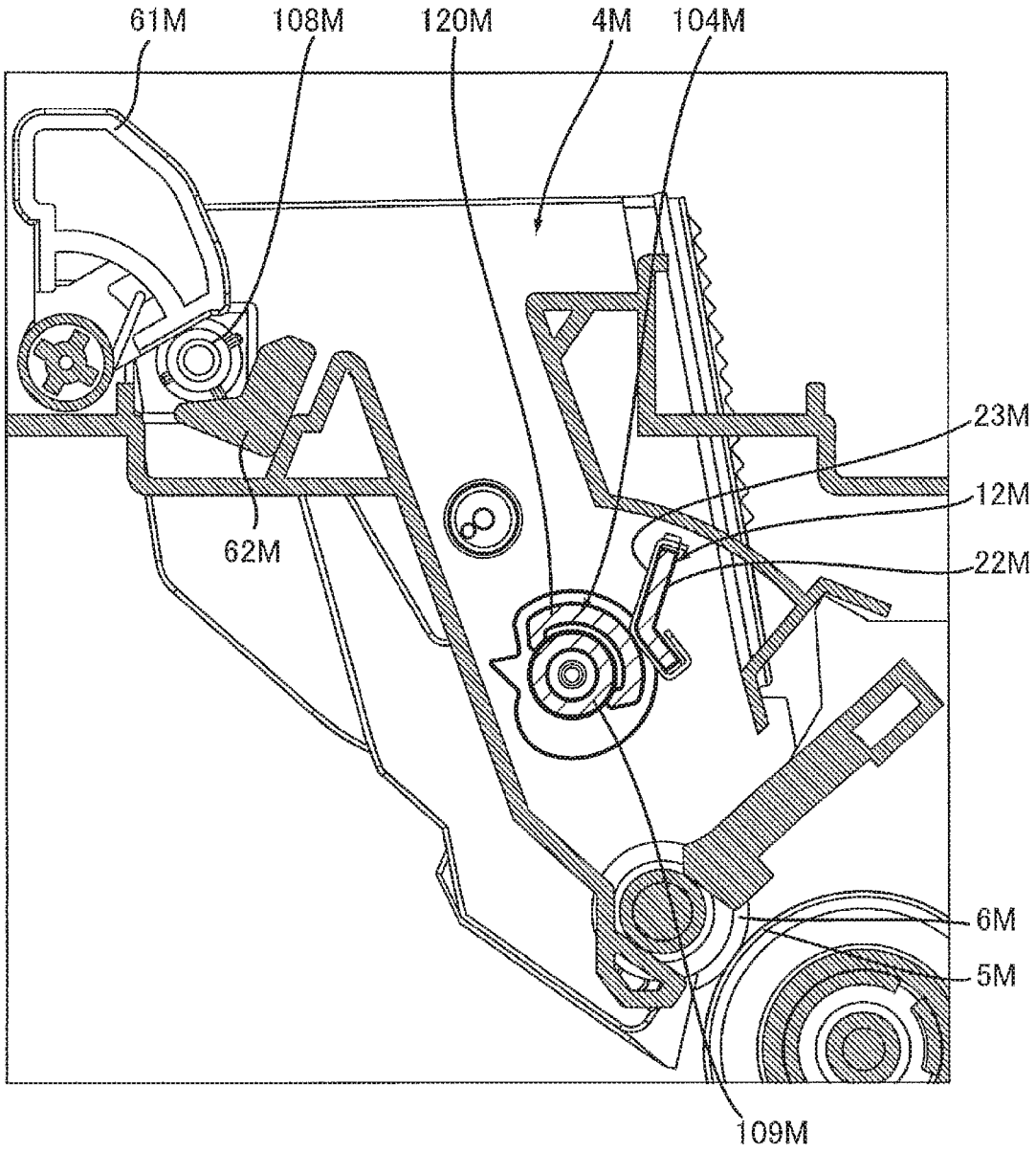

As a result, as shown in FIG. 13, the detecting protrusion 120M is brought into abutment contact with the lever 12M that is disposed in the first position. In other words, the detecting protrusion 120M contacts the protrusion 22M of the lever 12M. As a result, as shown in FIG. 14, the lever 12M receives the drive force from the detection member 104M to move from the first position to the second position. Thus, the lever 12M moves from the first position to the second position by the drive force transmitted from the detection member 104M, while the cartridge support member 3 stays at the inside position with the cartridge 4M being held therein. It is noted that the lever 12M is capable of moving between the first position and the second position by the drive force transmitted from the detection member 104M, while the cartridge support member 3 stays at the inside position with the cartridge 4M being held therein. Thus, the detecting protrusion 120M serves as a cam that rotates around the shaft 109M to move the lever 12M.

The detecting protrusion 120M becomes interposed between the electrode 23M of the lever 12M and the shaft 109M, thereby electrically disconnecting the electrode 23M from the shaft 109M and electrically connecting the electrode 23M to the second part 28M of the connecting member 15M. Thus, when the lever 12M reaches the second position, the support-member-side detection contact 42M becomes electrically connected with the main-body-side detection contact 202M. To summarize, the connecting member 15M electrically connects the support-member-side detection contact 42M to the main-body-side detection contact 202M when the lever 12M reaches the second position while the cartridge support unit 3 is at the inside position.

As a result, the developing bias is applied from the main-body-side developing-bias contact 201M to the main-body-side detection contact 202M through the support-member-side developing-bias electrode 13M, tension spring 14M, electrode 23M and connecting member 15M.

Accordingly, the detector 203 detects that the main-body-side detection contact 202M is electrically connected with the support-member-side detection contact 42M when the lever 12M has reached the second position.

When the detecting protrusion 120M further rotates, the detecting protrusion 120M moves away from the protrusion 22M of the lever 12M. Thereafter, the teeth portion 1040M of the detection member 104M becomes disengaged from the agitator gear 102M, whereupon the detection member 104M stops rotating. The detecting protrusion 120M also stops rotating.

When the detecting protrusion 120M becomes separated away from the protrusion 22M of the lever 12M, the lever 12M is pulled by the tension spring 14M in the direction away from the connecting member 15M, thereby moving back to the first position as illustrated in FIG. 12.

As a result, the electrode 23M of the lever 12M becomes separated away from the connecting member 15M, thereby electrically disconnecting the support-member-side detection contact 42M from the main-body-side detection contact 202M. The electrode 23M of the lever 12M is brought back into contact with the shaft 109M, thereby applying the developing bias to the shaft 109M.

The image forming apparatus 1 determines that the cartridge 4M is a new product in a case where the detector 203 detects that the main-body-side detection contact 202M is electrically connected with support-member-side detection contact 42M while the information on the cartridges 4K, 4Y, 4M and 4C is being read.

The image forming apparatus 1 determines that the cartridge 4M is a used cartridge in a case where the detector 203 does not detect that the main-body-side detection contact 202M is electrically connected with the support-member-side detection contact 42M while the information on the cartridges 4K, 4Y, 4M and 4C is being read.

Thereafter, the image forming apparatus 1 terminates the process of reading the information from the cartridges 4K, 4Y, 4M and 4C.

Whether the cartridge 4M is a new one or a used one is an example of information on the cartridge 4M. The pattern defined by the length of time, during which the main-body-side detection contact 202M and support-member-side detection contact 42M are in electrical connection with each other, and the number of times, by which the main-body-side detection contact 202M and the support-member-side detection contact 42M are brought into electrical connection with each other, can be associated with not only the data indicating whether the cartridge 4M is a new one or a used one, but also data indicating how many sheets can be printed with the toner contained in the cartridge 4M. The length of time, during which the main-body-side detection contact 202M and the support-member-side detection contact 42M have been in electrical connection with each other, and the number of times, by which the main-body-side detection contact 202M and the support-member-side detection contact 42M have been brought into electrical connection with each other, can be adjusted by modifying the shape of the detecting protrusion 120M.

6. Functions

In the image forming apparatus 1, when the cartridge support member 3 is disposed at the inside position with the cartridge 4M being held therein, as shown in FIGS. 11 to 14, the detecting protrusion 120M is brought into abutment contact with the lever 12M, whereupon the lever 12M moves from the first position to the second position by the drive force received from the detection member 104M. The detector 203 detects that the main-body-side detection contact 202M and the support-member-side detection contact 42M are brought into electrical connection with each other when the lever 12M has reached the second position.

Hence, although no photo-sensors are additionally provided in the housing 2 of the image forming apparatus 1 for the purpose of detecting the motion of the lever 12M, the detector 203 can detect that the lever 12M moves by detecting that the main-body-side detection contact 202M is electrically connected with the support-member-side detection contact 42M.

The image forming apparatus 1 can be made smaller than in the case where a photo-sensor is additionally provided in the housing 2 for the detection of the motion of the lever 12M.

7. Modifications

Each of the levers 12K, 12Y, 12M and 12C may be made of electrically conductive material in its entirety. Alternatively, each of the levers 12K, 12Y, 12M and 12C may be made, in part, of electrically conductive material. The electrically conductive material may be an electrically conductive resin.

Further, the detection member 104M may be configured to move linearly upon receipt of the drive force from the drive power source 211. In the embodiment, the detecting protrusion 120M is formed integrally with the detection member 104M. That is, the detection member 104M and the detecting protrusion 120M constitute a single component. However, the detecting protrusion 120M may be prepared as a component separate from the detection member 104M, and be attached to the detection member 104M.

In the embodiment described above, the covers 16K, 16Y, 16M and 16C for the respective colors are provided as separate components. Instead, the covers 16K, 16Y, 16M and 16C may be integrated into a single component.

In the above-described embodiment, the cartridge support member 3 is a drum unit that is provided with the plurality of photosensitive drums 5K, 5Y, 5M and 5C. Instead, the cartridge support member 3 may be provided with no photosensitive drums. In such a case, the developer cartridges 4K, 4Y, 4M and 4C are additionally provided with the photosensitive drums 5K, 5Y, 5M and 5C, respectively.

While the description has been made in detail with reference to specific embodiment thereof, it would be apparent to those skilled in the art that various changes and modifications may be made therein without departing from the spirit and scope of the above described aspects.

What is claimed is:

1. An image forming apparatus comprising:

a housing;

a drive source;

a cartridge configured to accommodate toner therein, the cartridge including a detection member movable upon receipt of a driving force from the drive source;

a main-body-side electrical contact provided at the housing;

a cartridge support member to which the cartridge is detachably attachable, the cartridge support member being movable between an inside position at which the cartridge support member is positioned inside the housing, and an outside position at which the cartridge support member is positioned outside of the housing;

a lever provided at the cartridge support member, the lever including a support-member-side electrical contact, the lever being movable between a first position and a second position by a driving force transmitted from the detection member in a state where the cartridge is attached to the cartridge support member and the cartridge support member is positioned at the inside position, in the first position the main-body-side electrical contact being out of electrical connection with the support-member-side electrical contact, and in the second position the main-body-side electrical contact being in electrical connection with the support-member-side electrical contact;

a connecting member provided at the cartridge support member, the connecting member being configured to electrically connect the main-body-side electrical contact to the support-member-side electrical contact in a state where the cartridge support member is at the inside position and the lever is at the second position; and a detector configured to detect electrical connection between the main-body-side electrical contact and the support-member-side electrical contact when the cartridge support member is at the inside position and the lever is at the second position.

2. The image forming apparatus according to claim 1, wherein the cartridge support member comprises a frame, to which the cartridge is detachably attachable, wherein the cartridge support member is movable in a first direction between the inside position and the outside position, wherein the lever is supported by the frame of the cartridge support member so as to be movable between the first position and the second position relative to the frame, wherein the connecting member is supported by the frame of the cartridge support member, and has a first electrical contact and a second electrical contact, wherein the first electrical contact is fixed to the frame, the first electrical contact being out of electrical contact with the main-body-side electrical contact in a state where the cartridge support member is at the outside position, and the first electrical contact being in electrical contact with the main-body-side electrical contact in a state where the cartridge support member is at the inside position, wherein the second electrical contact is out of electrical contact with the support-member-side electrical contact of the lever in a state where the lever is at the first position, the second electrical contact being in electrical contact with the support-member-side electrical contact of the lever in a state where the lever is at the second position, and wherein the detector is configured to detect that the main-body-side electrical contact and the support-member-side electrical contact are electrically connected with each other via the connecting member when the cartridge support member is at the inside position and the lever is at the second position.

3. The image forming apparatus according to claim 2, wherein the lever moves from the first position to the second position by the driving force transmitted from the detection member in the state where the cartridge is attached to the cartridge support member and the cartridge support member is positioned at the inside position.

4. The image forming apparatus according to claim 2, wherein the cartridge support member further comprises a tension spring including a first end connected to the frame, and a second end connected to the lever, wherein a distance between the first end and the second end in the state where the lever is at the second position is greater than the distance between the first end and the second end in the state where the lever is at the first position.

5. The image forming apparatus according to claim 4, wherein in a state where the cartridge is detached from the cartridge support member, the lever is at a third position different from both of the first position and the second position; and wherein a distance between the first end and the second end in a state where the lever is at the third position is smaller than the distance between the first end and the second end in the state where the lever is at the first position.

6. The image forming apparatus according to claim 5, wherein the cartridge is movable between a locked position and an unlocked position in the state where the cartridge is attached to the cartridge support member, in the locked position the cartridge being locked to the cartridge support member, and in the unlocked position a locked state of the cartridge with respect to the cartridge support member being released, wherein in a state where the cartridge is at the locked position, the lever is positioned at the first position, wherein in a state where the cartridge is at the unlocked position, the lever is positioned at a fourth position different from the first position, the second position, and the third position, and wherein a distance between the first end and the second end in a state where the lever is at the fourth position is greater than the distance in the state where the lever is at the second position.

7. The image forming apparatus according to claim 2, wherein the lever is pivotally movably supported to the frame.

8. The image forming apparatus according to claim 2, wherein the cartridge support member includes a first surface including a guide portion configured to guide attachment and detachment of the cartridge to and from the cartridge support member, and includes a second surface disposed at an opposite side of the cartridge with respect to the first surface, the lever being attached to the second surface.

9. The image forming apparatus according to claim 8, further comprising a boss extending from the second surface of the cartridge support member, the lever being attached to the boss.

10. The image forming apparatus according to claim 2, further comprising a cover fixed to the frame of the cartridge support member and configured to cover a part of the connecting member and expose the first electrical contact.

11. The image forming apparatus according to claim 10, wherein the connecting member comprises a wired spring.

12. The image forming apparatus according to claim 2, further comprising:

a main-body-side developing-bias electrical contact provided at the housing;

a developing roller provided in the cartridge; and a cartridge-side developing bias electrical contact provided at the cartridge and electrically connected to the developing roller, wherein the lever electrically connects the main-body-side developing-bias electrical contact to the cartridge-side developing bias electrical contact in a state where the cartridge is attached to the cartridge support member and the cartridge support member is positioned at the inside position.

13. The image forming apparatus according to claim 12, wherein the cartridge comprises a shaft including the cartridge-side developing bias electrical contact; and wherein the detection member is rotatable about the shaft in a rotational direction, and comprises a detecting protrusion covering a portion of a circumferential surface of the shaft in the rotational direction.

14. The image forming apparatus according to claim 13, wherein the detecting protrusion is a cam configured to abut against the lever to move the lever from the first position to the second position in a state where the cartridge is attached to the cartridge support member and the cartridge support member is positioned at the inside position.

15. The image forming apparatus according to claim 2, further comprising a photosensitive drum provided at the cartridge support member, the cartridge support member being attachable to and removable from the housing.

16. The image forming apparatus according to claim 2, wherein the lever comprises an electrode made from metal, the electrode including the support-member-side electrical contact.

17. The image forming apparatus according to claim 2, wherein the lever is made from an electrically conductive material.

18. The image forming apparatus according to claim 2, wherein the detection member comprises a tooth-missing gear.

19. The image forming apparatus according to claim 2, wherein the frame of the cartridge supporting member includes a first wall and a second wall spaced apart from each other in a second direction perpendicular to the first direction, and wherein the lever is supported by the first wall so as to be pivotally movable relative to the first wall about an axis extending in the second direction.

20. A drum unit to which a cartridge is detachably attachable, the cartridge being configured to accommodate toner therein and including a detection member movable upon receipt of a driving force, the drum unit comprising:

a frame;

a photosensitive drum rotatably supported by the frame;

a lever including an electrical contact, the lever being supported by the frame so as to be movable relative to the frame upon receipt of a driving force from the detection member in a state where the cartridge is attached to the drum unit;

a tension spring including a first end connected to the frame, and a second end connected to the lever; and a connecting member supported by the frame and electrically connectable to the electrical contact of the lever, wherein the lever is supported by the frame so as to be movable relative to the frame between a first position where the electrical contact is away from the connecting member and a second position where the electrical contact is in contact with the connecting member, wherein the connecting member comprises a first electrical contact and a second electrical contact, wherein the second electrical contact is out of electrical contact with the electrical contact of the lever in a state where the lever is at the first position, the second electrical contact being in electrical contact with the electrical contact of the lever in a state where the lever is at the second position, wherein the first electrical contact is fixed to the frame and is configured to allow an electrical connection between the electrical contact of the lever and the second electrical contact of the connecting member, which occurs when the lever is at the second position, to be detected via the first electrical contact of the connecting member, and wherein a distance between the first end and the second end of the tension spring in the state where the lever is at the second position is greater than the distance between the first end and the second end of the tension spring in the state where the lever is at the first position.

21. The drum unit according to claim 20, wherein the lever is configured to move from the first position to the second position by the driving force transmitted from the detection member in the state where the cartridge is attached to the drum unit.

22. The drum unit according to claim 20, further comprising a cover fixed to the frame and covering a part of the connecting member and exposing the first electrical contact of the connecting member.

23. The drum unit according to claim 20, wherein the connecting member comprises a wired spring.

24. The drum unit according to claim 20, wherein the lever is pivotally movably supported to the frame.

25. The drum unit according to claim 20, wherein the frame includes a first surface including a guide portion configured to guide attachment and detachment of the cartridge to and from the frame, and the frame includes a second surface disposed opposite to the cartridge with respect to the first surface, the lever being attached to the second surface.

26. The drum unit according to claim 25, further comprising a boss extending from the second surface, the lever being attached to the boss.

27. The drum unit according to claim 20, wherein the lever comprises an electrode made from metal.

28. The drum unit according to claim 20, wherein the lever is made from an electrically conductive material.

29. The drum unit according to claim 20, wherein the frame includes a first wall and a second wall spaced apart from each other, and wherein the lever is supported by the first wall so as to be pivotally movable relative to the first wall about an axis extending in a direction, in which the first wall and the second wall are spaced apart from each other.

* * * * *